US010061262B2

(12) United States Patent
Ushikubo

(10) Patent No.: US 10,061,262 B2
(45) Date of Patent: Aug. 28, 2018

(54) DEVELOPER CONTAINER ATTACHED DETACHABLY TO ATTACHMENT UNIT OF IMAGE FORMING UNIT, IMAGE FORMING UNIT, AND IMAGE FORMING APPARATUS

(71) Applicant: Oki Data Corporation, Tokyo (JP)

(72) Inventor: Junichi Ushikubo, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/491,375

(22) Filed: Apr. 19, 2017

(65) Prior Publication Data

US 2017/0329277 A1 Nov. 16, 2017

(30) Foreign Application Priority Data

May 13, 2016 (JP) ..... 2016-096812

(51) Int. Cl.
*G03G 15/08* (2006.01)
*G03G 21/16* (2006.01)

(52) U.S. Cl.
CPC ..... *G03G 21/1647* (2013.01); *G03G 15/0875* (2013.01); *G03G 15/0886* (2013.01); *G03G 15/0896* (2013.01); *G03G 21/1676* (2013.01)

(58) Field of Classification Search
CPC ..... G03G 15/0832
USPC ..... 399/258, 262
See application file for complete search history.

(56) References Cited

U.S. PATENT DOCUMENTS 6,301,460 B1 * 10/2001 Elliott ..... G03G 15/0126 399/262
2009/0142105 A1 6/2009 Yanagi

FOREIGN PATENT DOCUMENTS

EP 1890199 A2 2/2008
EP 2551728 A2 1/2013
JP 2006-113146 A 4/2006

* cited by examiner

*Primary Examiner* — William R Royer
(74) *Attorney, Agent, or Firm* — Rabin & Berdo, P.C.

(57) ABSTRACT

An image forming unit has a configuration in which, when an opening-closing member causes respective first openings to be opened by the engagement of the opening-closing member and an engaging section in association with an operation of attaching a developer container to an attachment unit, a first surface and a second surface are separated away from each other until arrival of the first openings at positions corresponding to respective second openings, and the first surface and the second surface are brought into proximity to each other upon the arrival of the first openings at the positions corresponding to the respective second openings.

9 Claims, 17 Drawing Sheets

DEVELOPER CONTAINER ATTACHED DETACHABLY TO ATTACHMENT UNIT OF IMAGE FORMING UNIT, IMAGE FORMING UNIT, AND IMAGE FORMING APPARATUS

CROSS REFERENCE TO RELATED APPLICATIONS

The present application claims priority from Japanese Patent Application No. 2016-096812 filed on May 13, 2016, the entire contents of which are hereby incorporated by reference.

BACKGROUND

The technology relates to a developer container that contains a developer, an image forming unit, and an image forming apparatus.

Some existing techniques have a configuration in which a single developer container contains developers of respective colors, and is attachable to and detachable from an image forming unit of an image forming apparatus. In a case where such a developer container is attached to the image forming unit and thereby feeds the developers to the image forming unit, the developer container may be caused to pivot after the attachment of the developer container to the image forming unit, and thereby cause outlets of the developers to be opened. For example, reference is made to Japanese Unexamined Patent Application Publication No. 2006-113146.

SUMMARY

According to an existing technique, upon feeding of developers to an image forming unit, it is necessary to cause a developer container to pivot after attaching the developer container to the image forming unit. This makes an operation of the developer container complicated.

It is therefore desirable to provide a developer container, an image forming unit, and an image forming apparatus that improve usability of the developer container upon feeding of developers to the image forming unit.

According to one embodiment of the technology, there is provided an image forming unit including a plurality of image forming sections, a developer container containing a developer, and an attachment unit to which the developer container is to be attached detachably. The developer container has a plurality of developer containing sections, first openings, and an opening-closing member. The attachment unit has a plurality of second openings, a guide, and an engaging section. The developer containing sections are disposed side by side in an attachment direction in which the developer container is to be attached to the attachment unit. The first openings are provided in the respective developer containing sections. The opening-closing member is slidable in the attachment direction and causes each of the first openings to be opened and closed. The second openings are in communication with the respective image forming sections. The guide guides the developer container in the attachment direction, and causes a first surface and a second surface to be brought into proximity to each other and to be separated away from each other. The first surface is provided with the opening-closing member of the developer container. The second surface is provided with the second openings. The engaging section is to be brought into engagement with the opening-closing member. When the opening-closing member causes the respective first openings to be opened by the engagement of the opening-closing member and the engaging section in association with an operation of attaching the developer container to the attachment unit, the first surface and the second surface are separated away from each other until arrival of the first openings at positions corresponding to the respective second openings, and the first surface and the second surface are brought into the proximity to each other upon the arrival of the first openings at the positions corresponding to the respective second openings.

According to one embodiment of the technology, there is provided a developer container including a plurality of developer containing sections and an opening-closing member. The plurality of developer containing sections are disposed side by side in an attachment direction in which the developer container is to be attached to an attachment unit, and have respective first openings. The opening-closing member is slidable in the attachment direction and causes each of the first openings to be opened and closed. The developer container is detachably attachable to the attachment unit of an image forming unit. When the opening-closing member causes the respective first openings to be opened in association with an operation of attaching the developer container to the attachment unit, a first surface and a second surface are separated away from each other until arrival of the first openings at positions corresponding to respective second openings, and the first surface and the second surface are brought into proximity to each other upon the arrival of the first openings at the positions corresponding to the respective second openings. The first surface is provided with the opening-closing member. The second surface is provided with the second openings. The second openings are provided in the attachment unit.

According to one embodiment of the technology, there is provided an image forming apparatus including the foregoing image forming unit.

DETAILED DESCRIPTION

A developer container, an image forming unit, and an image forming apparatus each according to one example embodiment of the technology are described below with reference to the drawings.

Example Embodiment

Figure 2:
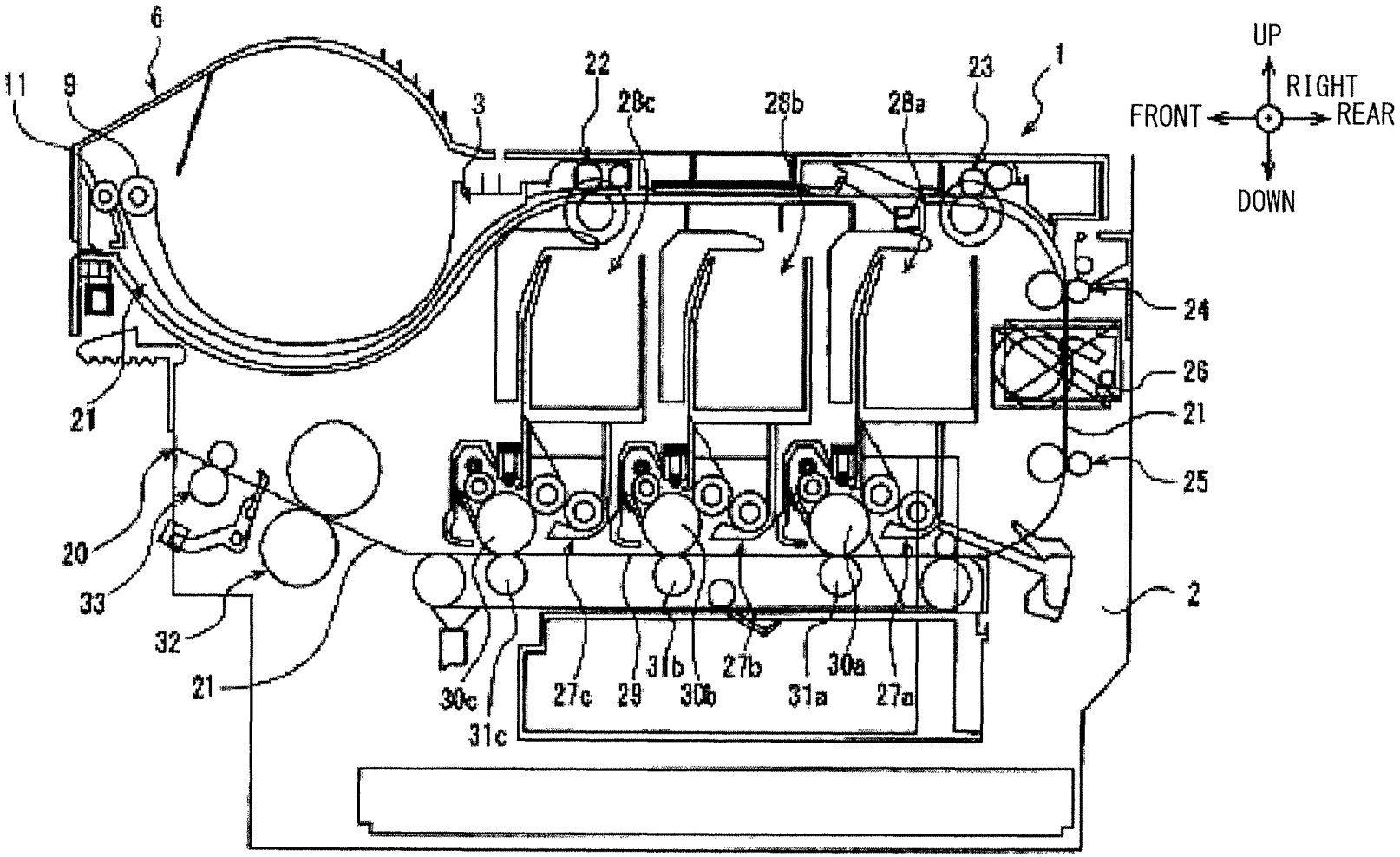
FIG. 2 is a schematic cross-sectional view of a configuration example of an image forming apparatus according to one example embodiment as viewed from a side thereof.

FIG. 2 is a schematic cross-sectional view of a configuration example of an image forming apparatus (an image forming apparatus 1) according to one example embodiment that is viewed from a side thereof.

Referring to FIG. 2, the image forming apparatus 1 may be a printer that includes an image forming unit of an electrophotography scheme, for example. The image forming apparatus 1 may include a housing 2 that substantially has a box shape. A surface, of the housing 2, that is on the left side in the diagram may be referred to as a front surface. A surface, of the housing 2, that is on the right side in the diagram may be referred to as a rear surface. A direction from the rear surface toward the front surface of the housing 2 may be referred to as a frontward direction or its variants. A direction from the front surface toward the rear surface of the housing 2 may be referred to as a rearward direction or its variants. A direction from the lower side toward upper side of the housing 2 may be referred to as an upward direction or its variants. A direction from the upper side toward the lower side of the housing 2 may be referred to as a downward direction or its variants. A direction in which a depth in the paper plane of FIG. 2 including the housing 2 increases may be referred to as a leftward direction or its variants. A direction in which the depth in the paper plane of FIG. 2 including the housing 2 decreases may be referred to as a rightward direction or its variants.

A medium container 3 may be provided on the front side of an upper part of the housing 2. The medium container 3 may contain a medium such as a roll of paper that is wound in a cylindrical shape.

Further, a cover 6 may be provided on the front side of the upper part of the housing 2. The cover 6 may cover the medium container 3.

The image forming apparatus 1 may contain the medium such as the cylindrical-shaped roll of paper in space that includes containing space of the medium container 3 and inner space of the cover 6 in a closed state. Such space may have a cylindrical shape, for example.

The medium container 3 may be provided with a container-side conveying roller 9 and a cover-side conveying roller 11. The container-side conveying roller 9 may be provided at a front end of an upper part of the containing space of the medium container 3. When the cover 6 is in the closed state, the cover-side conveying roller 11 may be so brought into contact with the container-side conveying roller 9 that the medium is sandwiched between the container-side conveying roller 9 and the cover-side conveying roller 11 to be conveyed.

The image forming apparatus 1 may have a conveying path 21 inside the housing 2. The conveying path 21 may extend from the front end of the medium container 3 along a lower part of the medium container 3 to a rear end of the medium container 3, and further extend to a medium discharge section 20 via pairs of conveying rollers 22, 23, 24, 25, and 33.

The conveying path 21 may be a path along which the medium contained in the medium container 3 is to be conveyed to the medium discharge section 20. The medium container 3 side of the conveying path 21 may be referred to as upstream and medium discharge section 20 side of the conveying path 21 may be referred to as downstream.

Each of the pairs of conveying rollers 22, 23, 24, 25, and 33 may convey the medium while sandwiching the medium in between. The pair of conveying rollers 22, 23, 24, 25, and 33 may be disposed in order from the upstream of the conveying path 21.

A housing-side cutter 26 may be disposed between the pair of conveying rollers 24 and the pair of conveying rollers 25. The housing-side cutter 26 may cut the medium.

Image forming sections 27*a*, 27*b*, and 27*c* may be disposed along the conveying path 21 between the pair of conveying rollers 25 and the pair of conveying rollers 33.

The respective image forming sections 27*a*, 27*b*, and 27*c* may form images of toners of a plurality of colors, for example, of three colors. The toners each may correspond to a "developer" according to one specific but non-limiting embodiment of the technology. The image forming section 27*a*, the image forming section 27*b*, and the image forming section 27*c* may be disposed side by side in order from the upstream of the conveying path 21. Toner containing sections 28*a*, 28*b*, and 28*c* may be attached to the image forming sections 27*a*, 27*b*, and 27*c*, respectively. Each of the toner containing sections 28*a*, 28*b*, and 28*c* may contain a corresponding toner. The image forming sections 27*a*, 27*b*, and 27*c* may be collectively referred to as an image forming section 27.

A circular transfer belt 29 and transfer rollers 31*a*, 31*b*, and 31*c* may be provided on lower side of the image forming sections 27*a*, 27*b*, and 27*c*. The transfer belt 29 may extend in a front-rear direction along the conveying path 21.

The transfer rollers 31*a*, 31*b*, and 31*c* may be disposed at positions that face photosensitive drums 30*a*, 30*b*, and 30*c* of the image forming sections 27*a*, 27*b*, and 27*c*, respectively, with the transfer belt 29 in between.

A fixing unit 32 may be provided at a downstream part of the transfer belt 29. Further, the pair of conveying rollers 33 may be provided at a position that is downstream of the fixing unit 32 and is in the vicinity of the medium discharge section 20.

Figure 1:
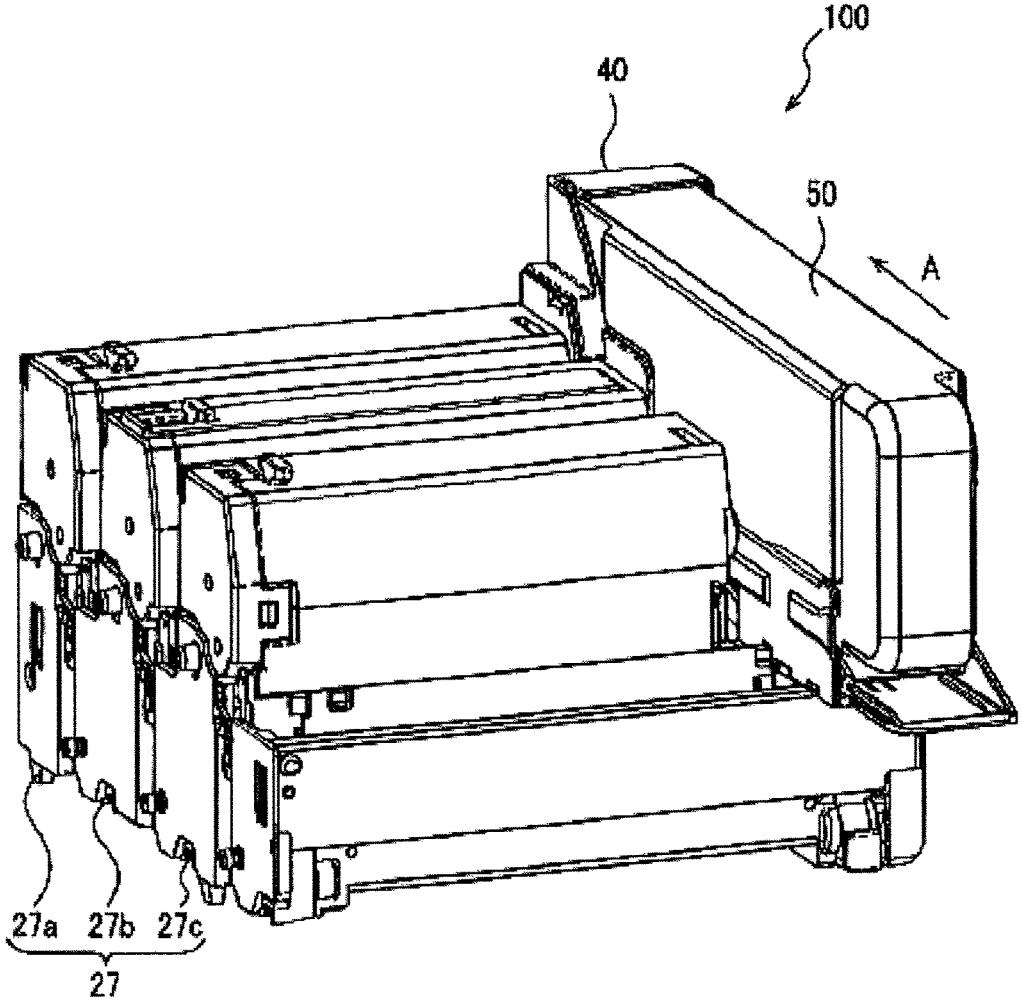
FIG. 1 is a perspective view of an appearance of an image forming unit according to one example embodiment.

FIG. 1 is a perspective view of an appearance of an image forming unit 100 according to one example embodiment.

Referring to FIG. 1, the image forming unit 100 may include the image forming sections 27, a stage 40, and a toner cartridge 50.

Each of the image forming sections 27 (27*a*, 27*b*, and 27*c*) may form a toner image, as a developer image, by means of the electrophotography scheme. The image forming sections 27 may include a photosensitive drum (corresponding one of the photosensitive drums 30*a*, 30*b*, and 30*c* illustrated in FIG. 2), a charging unit, an exposure unit, and a developing unit. The photosensitive drum may serve as an image supporting body that is rotatable. The charging unit may uniformly charge a surface of the photosensitive drum. The exposure unit may selectively apply light on the charged surface of the photosensitive drum and thereby form an electrostatic latent image. The developing unit may feed the toner as the developer to the electrostatic latent image formed on the photosensitive drum, and thereby form the toner image.

The image forming sections 27 of the present example embodiment may include the image forming sections 27*a*, 27*b*, and 27*c* that are disposed side by side in order in a medium conveyance direction in which the medium is conveyed, for example. The image forming section 27*a* may form a yellow toner image, for example. The image forming section 27*b* may form a magenta toner image, for example. The image forming section 27*c* may form a cyan toner image, for example.

The stage 40 may correspond to an "attachment unit" according to one specific but non-limiting example embodiment. The stage 40 may be provided at one end of the image forming sections 27 in a direction intersecting the medium conveyance direction, i.e., on the right side of the image forming apparatus 1 illustrated in FIG. 2. The stage 40 may allow the toner cartridge 50 to be attachable and detachable.

The toner cartridge 50 may correspond to a "developer container" according to one specific but non-limiting embodiment of the technology. The toner cartridge 50 may contain the toners of the respective colors. The toner cartridge 50 may be attachable to and detachable from the stage 40. Upon lack of toner in any of the image forming sections 27*a*, 27*b*, and 27*c*, the toner cartridge 50 that has been attached to the stage 40 may be detached from the stage 40. Further, another toner cartridge 50 that contains the toners of the respective colors may be inserted into the stage 40 in a direction indicated by an arrow A of FIG. 1 and thereby attached to the stage 40. Each of the toners of the respective colors may be thereby fed to the corresponding one of the image forming sections 27*a*, 27*b*, and 27*c*. The direction, indicated by the arrow A in the diagrams, in which the toner cartridge 50 is attached to the stage 40 is hereinafter referred to as a toner cartridge attachment direction A.

Figure 3:
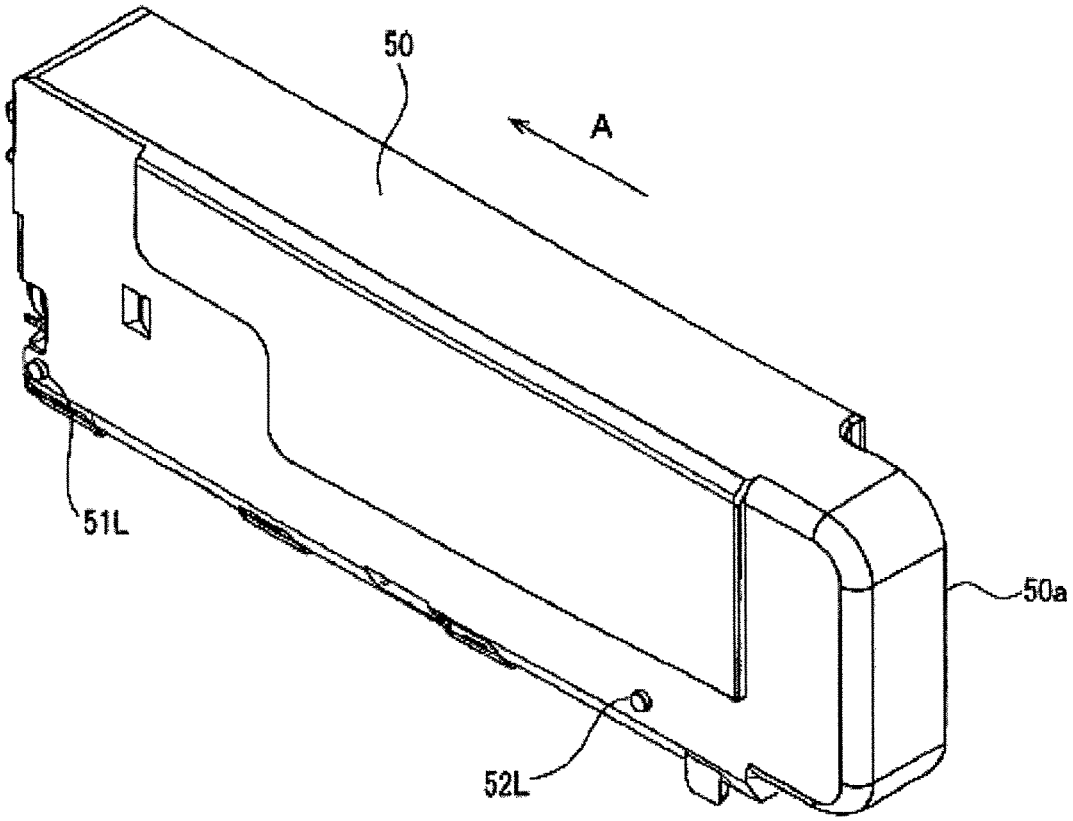
FIG. 3 is a perspective view of an appearance of a toner cartridge according to one example embodiment.
Figure 4:
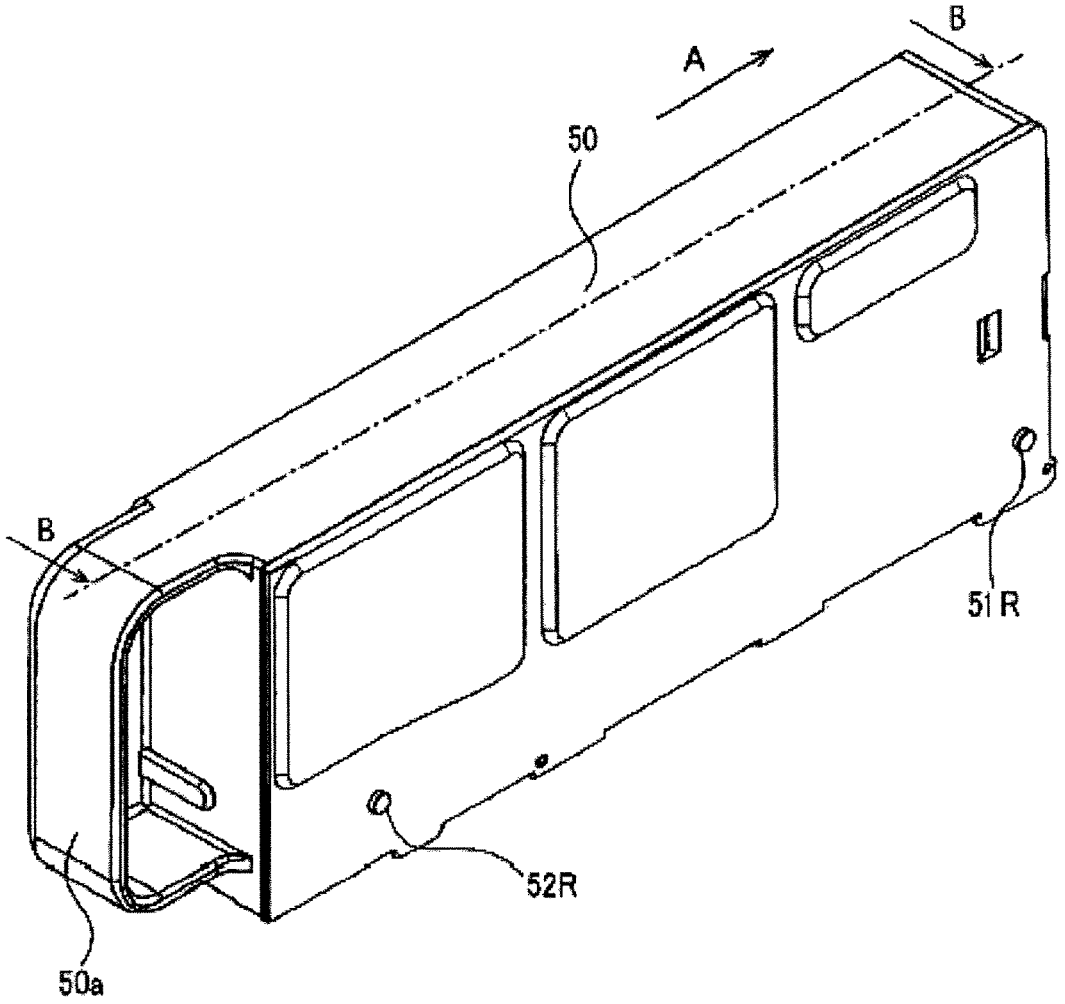
FIG. 4 is another perspective view of the appearance of the toner cartridge according to one example embodiment.

FIGS. 3 and 4 are each a perspective view of an appearance of the toner cartridge 50 according to one example embodiment.

Referring to FIGS. 3 and 4, the toner cartridge 50 may include posts 51L and 52L that are provided on a left side surface, of the toner cartridge 50, in the toner cartridge attachment direction A when the toner cartridge 50 is attached to the stage 40 illustrated in FIG. 1. The posts 51L and 52L may each be a protrusion that has a substantially-cylindrical shape. Further, the toner cartridge 50 may include posts 51R and 52R that are provided on a right side surface, of the toner cartridge 50, in the toner cartridge attachment direction A. The posts 51R and 52R may each be a protrusion that has a substantially-cylindrical shape. The post 51L and the post 51R may be provided at a front part of the toner cartridge 50 in the toner cartridge attachment direction A. The post 52L and the post 52R may be provided at a rear part of the toner cartridge 50 in the toner cartridge attachment direction A.

Further, a handling section 50*a* may be provided at a rear end of the toner cartridge 50 in the toner cartridge attachment direction A. The handling section 50*a* may be designated for operation of the toner cartridge 50 by a user. The user may hold the handling section 50*a* and move the toner cartridge 50 in the toner cartridge attachment direction A with respect to the stage 40 illustrated in FIG. 1. The user may thus attach the toner cartridge 50 to the stage 40. Alternatively, the user may hold the handling section 50*a* and move the toner cartridge 50 in a direction opposite to the toner cartridge attachment direction A with respect to the stage 40. The user may thus detach the toner cartridge 50 from the stage 40.

Figure 5:
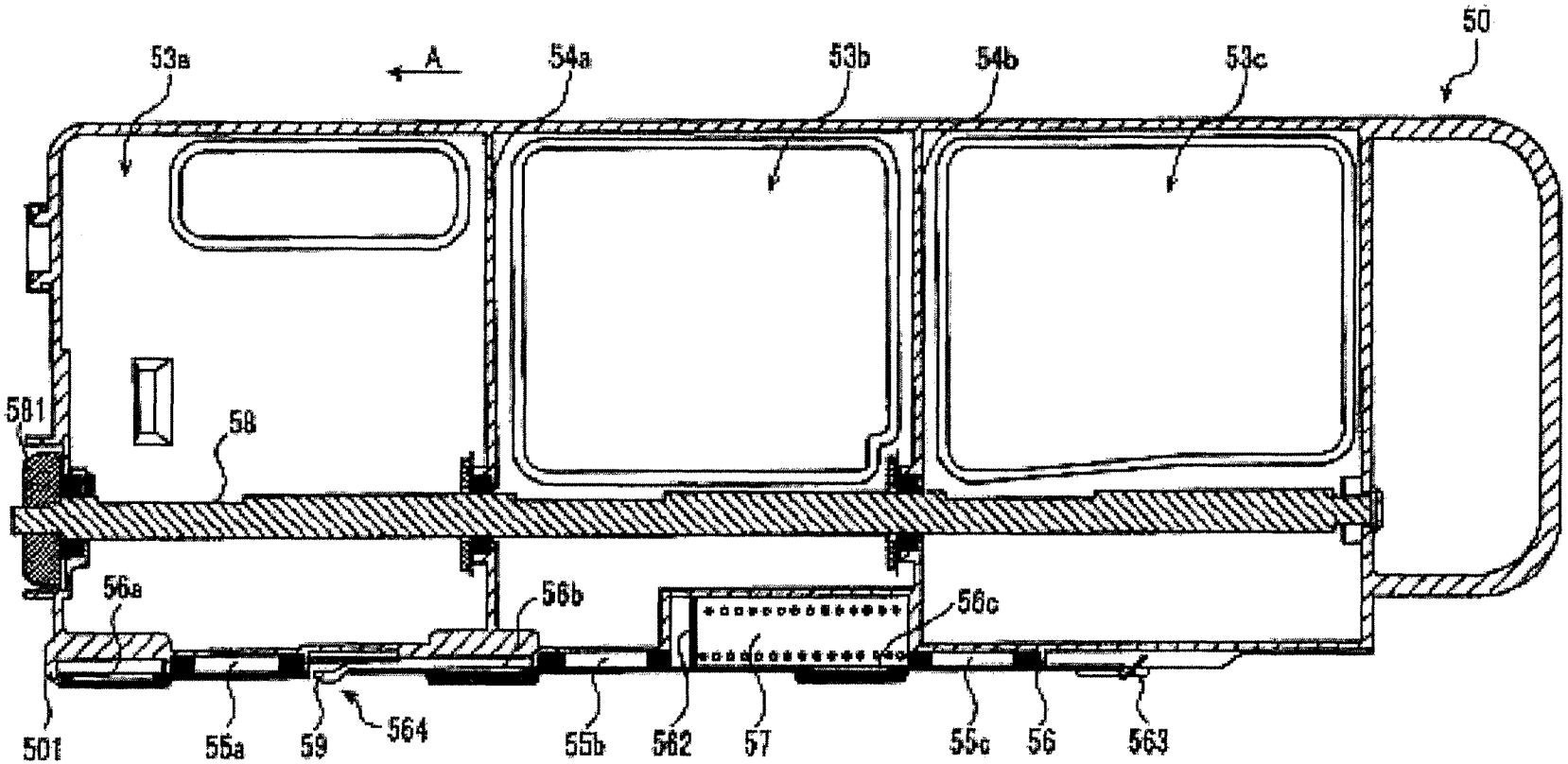
FIG. 5 is a cross-sectional view of the toner cartridge according to one example embodiment.

FIG. 5 is a cross-sectional view of the toner cartridge 50 according to one example embodiment, viewed in a direction indicated by arrows B of FIG. 4.

Referring to FIG. 5, the toner cartridge 50 may include toner containing sections 53*a*, 53*b*, and 53*c*, partitions 54*a* and 54*b*, openings 55*a*, 55*b*, and 55*c*, a shutter 56, a spring 57, a stirring member 58, and a stopper 59.

The toner containing sections 53*a*, 53*b*, and 53*c* may each correspond to a "developer containing section" according to one specific but non-limiting embodiment of the technology. The toner containing sections 53*a*, 53*b*, and 53*c* may each contain the toner of the corresponding color. The toner containing sections 53*a*, 53*b*, and 53*c* may be disposed side by side in the toner cartridge attachment direction A, i.e., the direction in which the toner cartridge 50 is to be attached to the stage 40. In the present example embodiment, the toner containing sections 53*a*, 53*b*, and 53*c* may be disposed in order from front side, i.e., downstream in the toner cartridge attachment direction A.

The toner containing section 53*a* may contain the yellow toner, for example. The toner containing section 53*b* may contain the magenta toner, for example. The toner containing section 53*c* may contain the cyan toner, for example. The toner containing sections 53*a*, 53*b*, and 53*c* may be so disposed as to correspond to the image forming sections 27*a*, 27*b*, and 27*c* illustrated in FIG. 1, respectively.

It is to be noted that the present example embodiment is described referring to an example case in which the three toner containing sections are provided. However, the number of the toner containing sections to be provided may be two or four or more as long as the number of the toner containing sections corresponds to the number of the image forming sections.

The partitions 54*a* and 54*b* each may be a wall that separates the toner containing sections from each other. The partition 54*a* may be disposed between the toner containing section 53*a* and the toner containing section 53*b*. The partition 54*b* may be disposed between the toner containing section 53*b* and the toner containing section 53*c*.

The openings 55*a*, 55*b*, and 55*c* each may correspond to a "first opening" according to one example embodiment of the technology. The openings 55*a*, 55*b*, and 55*c* each may be a hole that is provided at a lower part of corresponding one of the toner containing sections 53*a*, 53*b*, and 53*c*. The openings 55*a*, 55*b*, and 55*c* may allow the toners contained in the toner containing sections 53*a*, 53*b*, and 53*c* to pass therethrough. The openings 55*a*, 55*b*, and 55*c* each may have a predetermined length in the toner cartridge attachment direction A and may be provided at predetermined intervals in the toner cartridge attachment direction A. Accordingly, the openings 55*a*, 55*b*, and 55*c* may substantially have the same length with each other in the toner cartridge attachment direction A.

The shutter 56 may correspond to an "opening-closing member" according to one specific but non-limiting embodiment of the technology. The shutter 56 may be so provided at the lower part of the toner cartridge 50 as to be slidable in the toner cartridge attachment direction A and in a direction opposite to the toner cartridge attachment direction A. The shutter 56 may be a plate-like member that causes the respective openings 55*a*, 55*b*, and 55*c* to be closed or opened. The shutter 56 may serve as a bottom surface of the toner cartridge 50.

The shutter 56 may have openings 56*a*, 56*b*, and 56*c*. The openings 56*a*, 56*b*, and 56*c* may have predetermined lengths same as those of the openings 55*a*, 55*b*, and 55*c* in the toner cartridge attachment direction A, and disposed at intervals same as those of the openings 55*a*, 55*b*, and 55*c* in the toner cartridge attachment direction A. Accordingly, when the openings 56*a*, 56*b*, and 56*c* of the shutter 56 are located at positions corresponding to the openings 55*a*, 55*b*, and 55*c* of the toner containing sections 55*a*, 55*b*, and 55*c*, respectively, the shutter 56 may cause the openings 55*a*, 55*b*, and 55*c* to be opened. When the openings 56*a*, 56*b*, and 56*c* of the shutter 56 are located at positions not corresponding to the openings 55*a*, 55*b*, and 55*c* of the toner containing sections 55*a*, 55*b*, and 55*c*, respectively, the shutter 56 may cause the openings 55*a*, 55*b*, and 55*c* to be closed.

The shutter 56 may further include a contact part 562 and an engaged part 563. The contact part 562 may be in contact with the spring 57. The engaged part 563 may be brought into engagement with a protrusion provided on the stage 40 illustrated in FIG. 1.

The spring 57 may correspond to a "biasing member" according to one specific but non-limiting embodiment of the technology. The spring 57 may bias the shutter 56 in the toner cartridge attachment direction A. The shutter 56 biased by the spring 57 may be brought into contact with a contact part 501 that is provided at the lower part of the toner cartridge 50 and thereby stopped. The shutter 56 may thereby cause the openings 55*a*, 55*b*, and 55*c* of the toner containing sections 55*a*, 55*b*, and 55*c* to be closed. It is to be noted that FIG. 5 illustrates a state in which the shutter 56 is biased by the spring 57 of the toner cartridge 50, thereby causing the openings 55*a*, 55*b*, and 55*c* of the toner containing sections 55*a*, 55*b*, and 55*c* to be closed.

The stirring member 58 may extend in the toner cartridge attachment direction A and may be rotatable. The stirring member 58 may extend through the toner containing sections 53*a*, 53*b*, and 53*c*. A gear 581 may be provided at a tip end of the stirring member 58 in the toner cartridge attachment direction A. Rotation force supplied from a drive source of the image forming apparatus 1 illustrated in FIG. 2 may be transmitted to the gear 581, resulting in rotation of the stirring member 58. The stirring member 58 may so rotate as to stir the toners contained in the respective toner containing sections 53*a*, 53*b*, and 53*c*, thereby suppressing coagulation of the toners, for example. A sealing member may be so provided between the stirring member 58 and each of the partitions 54*a* and 54*b* as to prevent the toners in the respective toner containing sections 53*a*, 53*b*, and 53*c* from being mixed with each other.

A convex may be provided at a tip end of the stopper 59 serving as a retainer. The convex of the stopper 59 may be brought into engagement with a hole 564 provided in the shutter 56. The stopper 59 may thus regulate the sliding movement of the shutter 56. The stopper 59 may be so supported in a cantilever state that the convex provided at the tip end of the stopper 59 is movable upward and downward, for example. In the present example embodiment, the stopper 59 may so regulate the sliding movement of the shutter 56 as to maintain a state in which the shutter 56 causes the openings 55*a*, 55*b*, and 55*c* to be closed or opened. It is to be noted that the toner cartridge 50 may have a configuration without the stopper 59.

Figure 6:
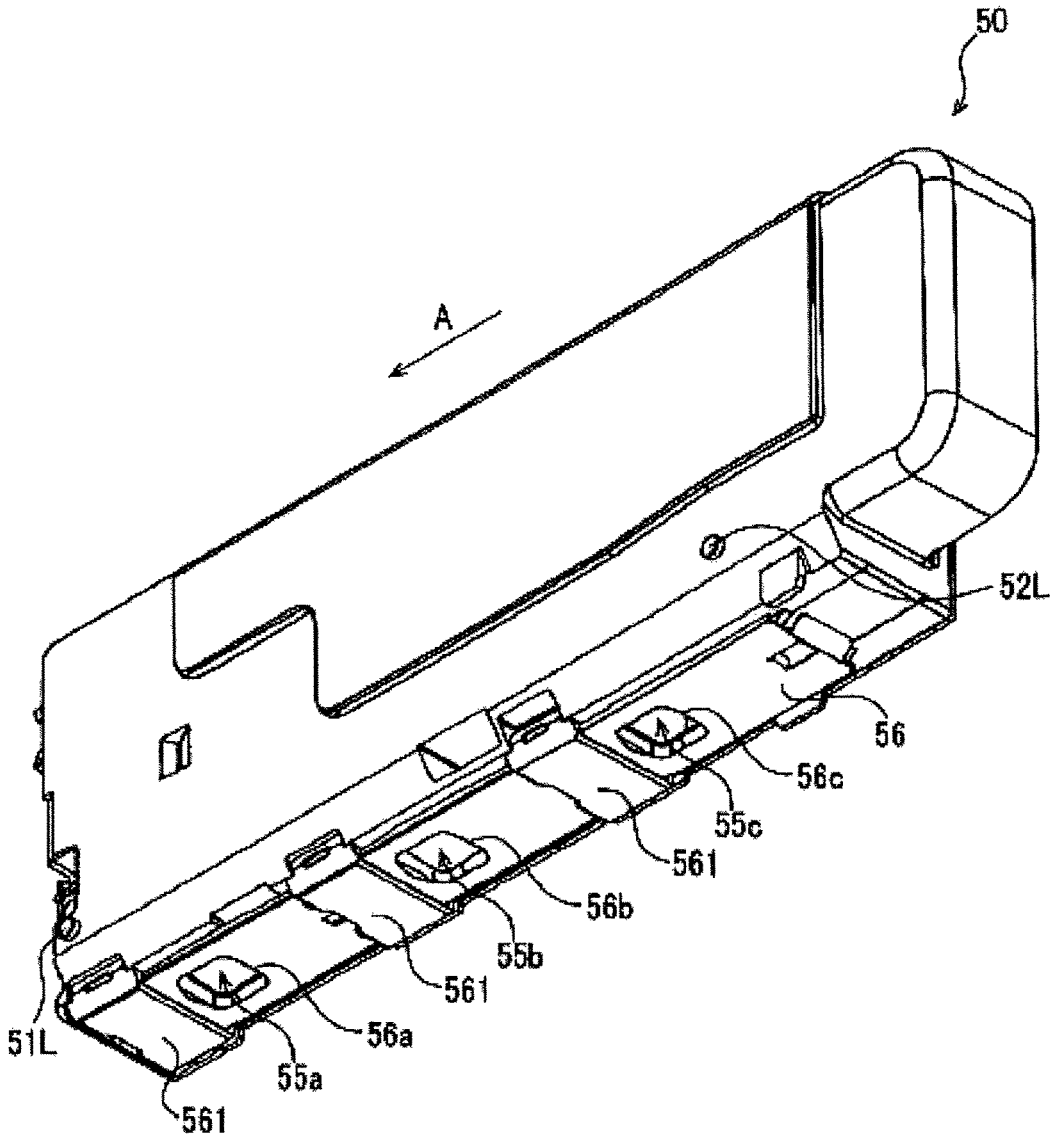
FIG. 6 is a perspective view of the toner cartridge according to one example embodiment.

FIG. 6 is a perspective view of the toner cartridge 50 according to one example embodiment, viewed from the bottom surface of the toner cartridge 50.

FIG. 6 illustrates a state in which the shutter 56 of the toner cartridge 50 causes the openings 55*a*, 55*b*, and 55*c* of the toner containing sections 55*a*, 55*b*, and 55*c* to be opened.

Referring to FIG. 6, when the openings 56*a*, 56*b*, and 56*c* of the shutter 56 are located at the positions corresponding to the openings 55*a*, 55*b*, and 55*c* of the toner containing sections (the toner containing sections 53*a*, 53*b*, and 53*c* illustrated in FIG. 5), respectively, the shutter 56 may cause the openings 55*a*, 55*b*, and 55*c* to be opened. Accordingly, the toners contained in the respective toner containing sections 53*a*, 53*b*, and 53*c* illustrated in FIG. 5 may pass through the openings 56*a*, 56*b*, and 56*c* and the openings 55*a*, 55*b*, and 55*c* and be discharged therefrom to be fed to the image forming sections 27*a*, 27*b*, and 27*c* illustrated in FIG. 1, respectively.

In the present example embodiment, a holding member 561 may be provided at the lower part of the toner cartridge 50. The holding member 561 may hold the shutter 56 in a slidable manner. The holding member 561 and the shutter 56 may configure the bottom surface of the toner cartridge 50. However, this is not limitative. Alternatively, the shutter 56 may be supported in a slidable manner owing to a guiding part provided in the body of the toner cartridge 50. The guiding part may be a groove, for example. In this example, the holding member 561 may be unnecessary.

Figure 7:
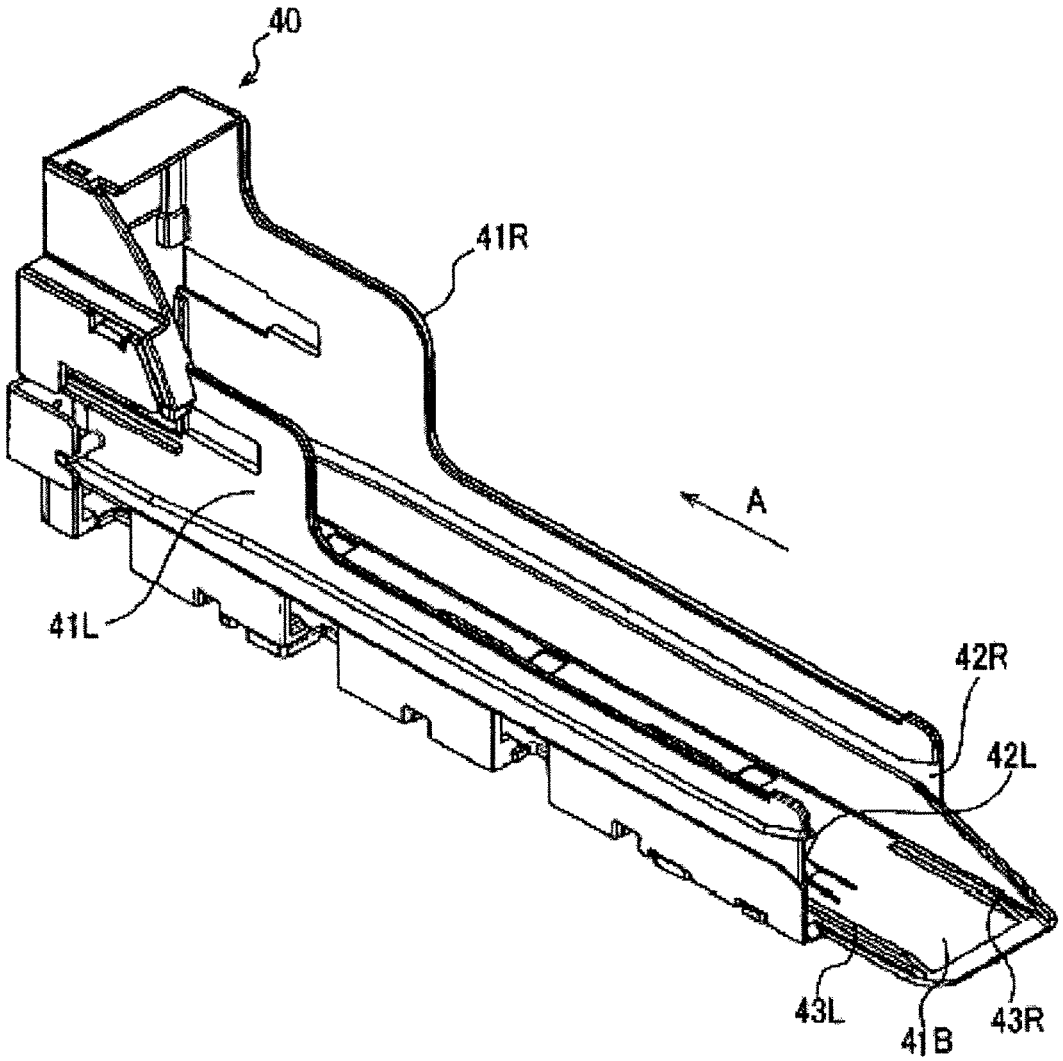
FIG. 7 is a perspective view of a stage according to one example embodiment.

FIG. 7 is a perspective view of the stage 40 according to one example embodiment.

Referring to FIG. 7, the stage 40 may include sidewalls 41L and 41R, a bottom plate 41B, rails 42L and 42R, and limiters 43L and 43R.

The sidewalls 41L and 41R may be provided on both left and right side parts of the stage 40 in the toner cartridge attachment direction A. The bottom plate 41B may serve as a bottom part of the stage 40.

The rails 42L and 42R may correspond to a "guide" according to one specific but non-limiting embodiment of the technology. The rails 42L and 42R each may be a guide (a groove) that is provided on inner part of the corresponding one of the sidewalls 41L and 41R and extend in the toner cartridge attachment direction A. The posts 51L and 51R and/or the posts 52L and 52R that are protrusions provided on both side parts of the toner cartridge 50 illustrated in FIGS. 3 and 4 may be fit into the rails 42L and 42R, respectively. The rails 42L and 42R may thus guide the toner cartridge 50 in a slidable manner.

The limiters 43L and 43R may be provided in regions on the inner side of the sidewalls 41L and 41R and at the left and right side parts of the bottom plate 41B, respectively, and extend in the toner cartridge attachment direction A. The limiters 43L and 43R each may be a convex member that has a predetermined height. When the posts 51L and 51R of the toner cartridge 50 illustrated in FIGS. 3 and 4 are fit into the rails 42L and 42R, respectively, the limiters 43L and 43R may be brought into contact with both side parts of the bottom surface of the toner cartridge 50. The limiters 43L and 43R may thereby cause the bottom surface of the toner cartridge 50 and the bottom plate 41B to be separated away from each other. This prevents the toner attached to the bottom surface of the toner cartridge 50 from being attached to the bottom plate 41B, and also prevents the toner attached to the bottom plate 41B from being attached to the bottom surface of the toner cartridge 50.

Figure 8:
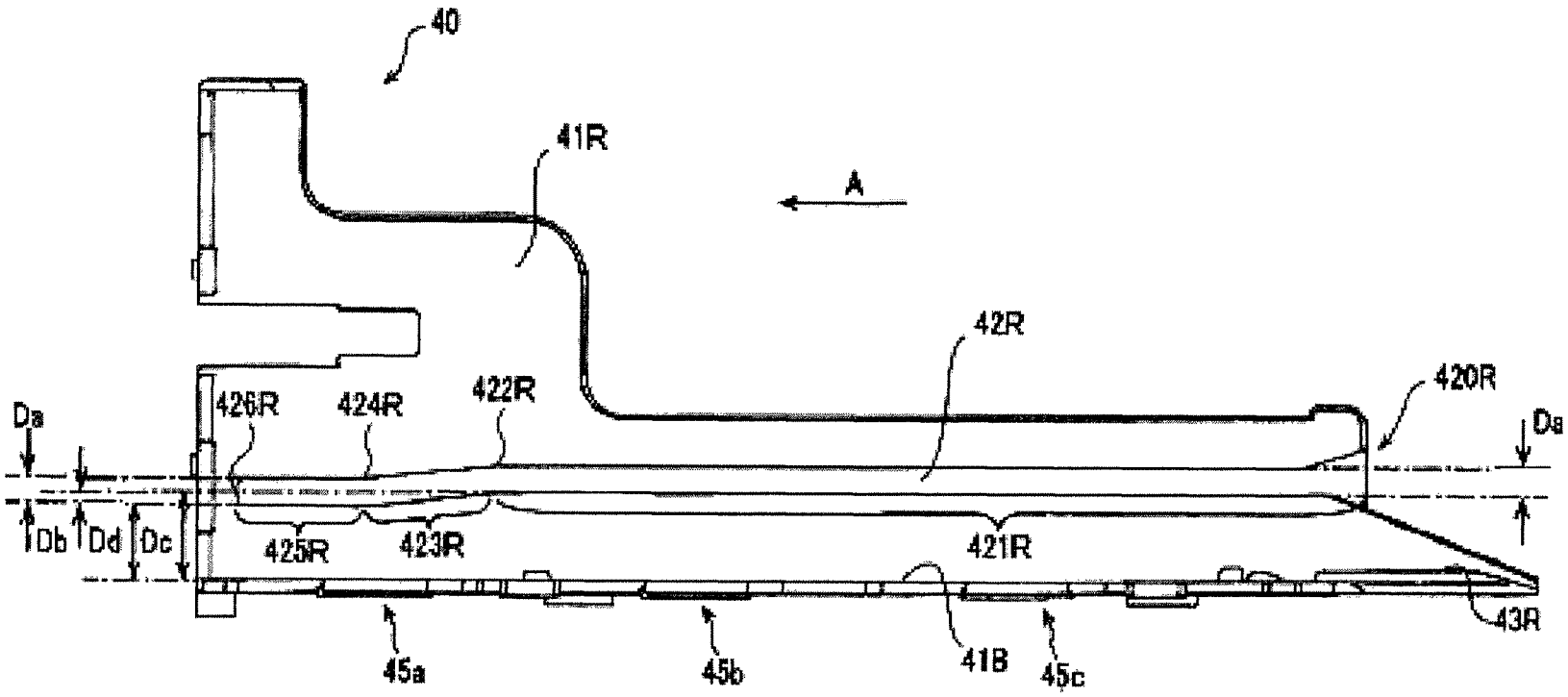
FIG. 8 describes the stage and a rail according to one example embodiment.

FIG. 8 describes the stage 40 and the rail 42R according to one example embodiment, and illustrates a side surface of the rail 42R illustrated in FIG. 7. It is to be noted that the rail 42L may have a configuration substantially similar to the configuration of the rail 42R.

Referring to FIG. 8, the stage 40 may have openings 45*a*, 45*b*, and 45*c*.

The openings 45*a*, 45*b*, and 45*c* each may correspond to a "second opening" according to one specific but non-limiting embodiment of the technology. The openings 45*a*, 45*b*, and 45*c* each may be a hole provided in the bottom plate 41B. The plurality of openings, i.e., the openings 45*a*, 45*b*, and 45*c* may be so provided as to correspond to the openings 55*a*, 55*b*, and 55*c* of the toner cartridge 50 illustrated in FIG. 5. The openings 45*a*, 45*b*, and 45*c* may have lengths that are substantially the same as those of the openings 55*a*, 55*b*, and 55*c* of the toner cartridge 50 illustrated in FIG. 5, respectively, in the toner cartridge attachment direction A. The openings 45*a*, 45*b*, and 45*c* may be disposed at intervals that are substantially the same as those of the openings 55*a*, 55*b*, and 55*c* in the toner cartridge attachment direction A.

The openings 45*a*, 45*b*, and 45*c* may be in communication with the image forming sections 27*a*, 27*b*, and 27*c* illustrated in FIG. 1, respectively. The openings 45*a*, 45*b*, and 45*c* may also allow the toners that have passed through the openings 55*a*, 55*b*, and 55*c* of the toner cartridge 50 to pass therethrough and thereby feed the toners to the image forming sections 27*a*, 27*b*, and 27*c*, respectively.

The rail 42R may include a first linear part 421R, a first curve 422R, a first slope 423R, a second curve 424R, and a second linear part 425R.

The first linear part 421R may extend from an insertion slot 420R to the first curve 422R. The insertion slot 420R may be located most upstream in the rail 42R in the toner cartridge attachment direction A. The first linear part 421R may be substantially parallel to the bottom plate 41B (the bottom surface).

The first curve 422R may be provided at a downstream end of the first linear part 421R in the toner cartridge attachment direction A. Hereinafter, for example, a wording such as "a downstream end of the first linear part 421R in the toner cartridge attachment direction A" may refer to an end of the first linear part 421R that is located relatively downstream in the toner cartridge attachment direction A compared to the other end of the first linear part 421R.

The first slope 423R may correspond to a "coupling part" according to one specific but non-limiting embodiment of the technology. The first slope 423R may be provided downstream of the first curve 422R in the toner cartridge attachment direction A. The first slope 423R may be sloped at a predetermined angle toward the downstream in the toner cartridge attachment direction A and toward the bottom plate 41B.

The second curve 424R may be provided at a downstream end of the first slope 423R in the toner cartridge attachment direction A.

The second linear part 425R may be provided downstream of the second curve 424R in the toner cartridge attachment direction A. The second linear part 425R may extend from the second curve 424R to a terminal end 426R that is located most downstream in the rail 42R in the toner cartridge attachment direction A. The second linear part 425R may be substantially parallel to the bottom plate 41B (the bottom surface).

As described above, the rail 42R (or 42L) may include: the first linear part 421R (or 421L) that is provided at the upstream part of the rail 42R (or 42L) in the toner cartridge attachment direction A; the second linear part 425R (or 425L) that is provided downstream of the first linear part 421R (or 421L) in the toner cartridge attachment direction A; and the first slope 423R (or 423L) that couples the downstream end of the first linear part 421R (or 421L) in the toner cartridge attachment direction A and the upstream end of the second linear part 425R (or 425L) to each other in the toner cartridge attachment direction A.

The rail 42R may have a height (a width) of Da. The height (the width) Da of the rail 42R may be substantially the same as or slightly greater than a diameter of each of the posts 51R and 52R, of the toner cartridge 50, that has the substantially-cylindrical shape illustrated in FIG. 4.

A difference in height between the lower surface of the first linear part 421R and a lower surface of the second linear part 425R may be Db.

In the present example embodiment, the difference Db in height may be half of the height Da. For example, the height Da may be about 4 mm, and the difference Db in height may be about 2 mm.

Accordingly, a distance Dc from the first linear part 421R to the bottom plate 41B (the bottom surface) may be greater than a distance Dd from the second linear part 425R to the bottom plate 41B (the bottom surface).

Figure 9A:
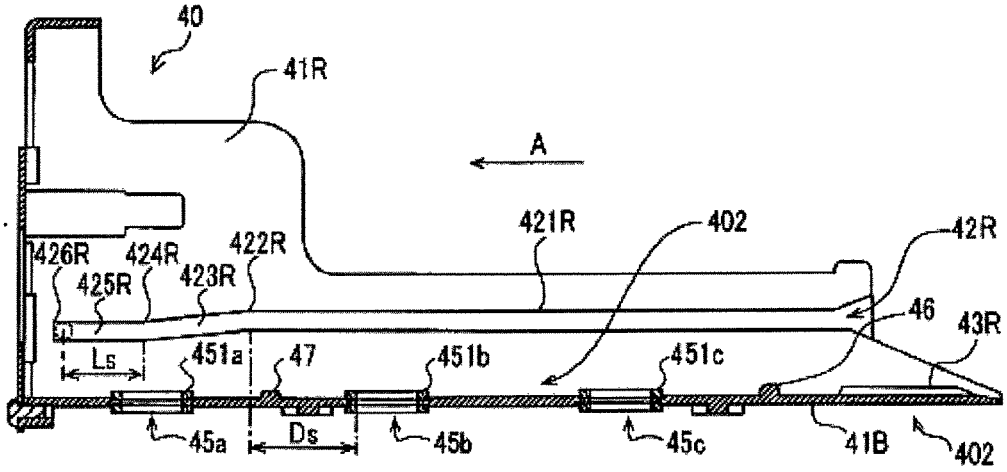
FIGS. 9A and 9B each describe a positional relationship between the rail and a post according to one example embodiment.
Figure 9B:
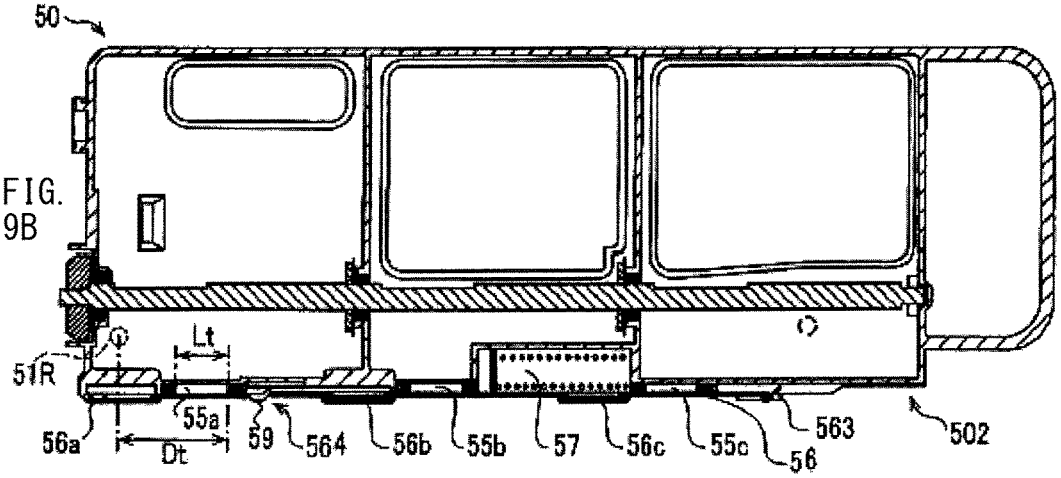

FIGS. 9A and 9B describe a positional relationship between the rail 42R and the post 51R according to one example embodiment. Specifically, FIG. 9A is a cross-sectional view of the stage 40 and includes the rail 42R. FIG. 9B is a cross-sectional view of the toner cartridge 50 viewed in the direction indicated by the arrows B of FIG. 4.

Referring to FIG. 9A, a distance may be Ds from the first curve 422R of the rail 42R of the stage 40 (the downstream end of the first linear part 421R) to the downstream end of the opening 45*b* that is located downstream of the openings 45*a*, 45*b*, and 45*c* in the toner cartridge attachment direction A.

Referring to FIG. 9B, a distance may be Dt from the center of the post 51R of the toner cartridge 50 to the upstream end of the opening 55*a* in the toner cartridge attachment direction A. It is to be noted that the post 51R may be provided downstream of the opening 55*a* that is located at most downstream in the openings 55*a*, 55*b*, and 55*c* in the toner cartridge attachment direction A.

In the present example embodiment, the rail 42R, the opening 45*b*, the post 51R, and the opening 55*a* may be so provided that at least the distance Ds is greater than the distance Dt, i.e., at least a relationship of (the distance Ds)>(the distance Dt) is satisfied.

One reason for this may be that this allows the opening 55*a* of the toner cartridge 50 to be located downward of the opening 45*b* of the stage 40 in the toner cartridge attachment direction A when the toner cartridge 50 is slid in the toner cartridge attachment direction A while the post 51R of the toner cartridge 50 is fit into the rail 42R, allowing the post 51R to arrive at the first curve 422R.

This makes it possible that, even when the toner is attached to a region around the opening 55*a* of the toner cartridge 50, the toner attached to the region around the opening 55*a* is prevented from being attached to the opening 45*b* of the stage 40. This prevents mixture of the toners having different colors from each other.

Further, referring to FIG. 9A, a length of the second linear part 425R in the toner cartridge attachment direction A may be Ls. Specifically, in this example embodiment, a distance may be Ls from the center of the post 51R of the toner cartridge 50 to the second curve 424R in a state where the post 51R is brought into contact with the terminal end 426R of the rail 42R of the stage 40.

Further, referring to FIG. 9B, the length of the opening 55*a* of the toner cartridge 50 in the toner cartridge attachment direction A may be Lt. Specifically, a distance may be Lt from the upstream end of the opening 55*a* to the downstream end of the opening 55*a* in the toner cartridge attachment direction A.

In the present example embodiment, the rail 42R and the opening 55*a* may be so provided that at least the distance Ls is greater than the distance Lt, i.e., at least a relationship of (the distance Ls)>(the distance Lt) is satisfied.

One reason for this may be that this allows the opening 56*a* of the shutter 56 to correspond to the opening 55*a* of the toner cartridge 50 when the toner cartridge 50 is slid in the toner cartridge attachment direction A is fit into the rail 42R, allowing the post 51R to arrive at the second curve 424R.

One reason why the distance Ls is set as the length of the second linear part 425R is that this allows the post 51R to also have a pin shape with a small radius.

In the present example embodiment, referring to FIG. 9A, projections 46 and 47 may be provided on the bottom plate 41B of the stage 40. The projections 46 and 47 may correspond to an "engaging section" according to one specific but non-limiting embodiment of the technology. When the post 51R of the toner cartridge 50 illustrated in FIG. 9B arrives at the second curve 424R, the convex of the tip end of the stopper 59 of the toner cartridge 50 may be brought into contact with the projection 47 of the stage 40. This may release the engagement of the stopper 59 and the hole 564 of the shutter 56 with each other, allowing for sliding of the shutter 56 with respect to the toner cartridge 50. Further, when the post 51R of the toner cartridge 50 illustrated in FIG. 9B arrives at the second curve 424R, the engaged part 563 of the shutter 56 of the toner cartridge 50 and the projection 46 may be brought into contact with each other, and thereby brought into engagement with each other.

In the present example embodiment, referring to FIG. 9A, each of sealing members 451*a*, 451*b*, and 451*c* may be provided on a surface, around corresponding one of the openings 45*a*, 45*b*, and 45*c*, which is to be brought into contact with the toner cartridge 50.

The rail 42L of the stage 40 may have a configuration similar to that of the rail 42R.

In the foregoing manner, the rail 42R (or 42L) may guide the toner cartridge 50 in the toner cartridge attachment direction A, and cause a first surface (a bottom surface) 502 and a second surface 402 to be brought into proximity to each other or to be separated away from each other. The first surface 502 may be provided with the shutter 56 of the toner cartridge 50. The second surface 402 may be a surface, of the bottom plate 41B of the stage 40, in which the openings 45*a*, 45*b*, and 45*c* are provided.

Figure 10:
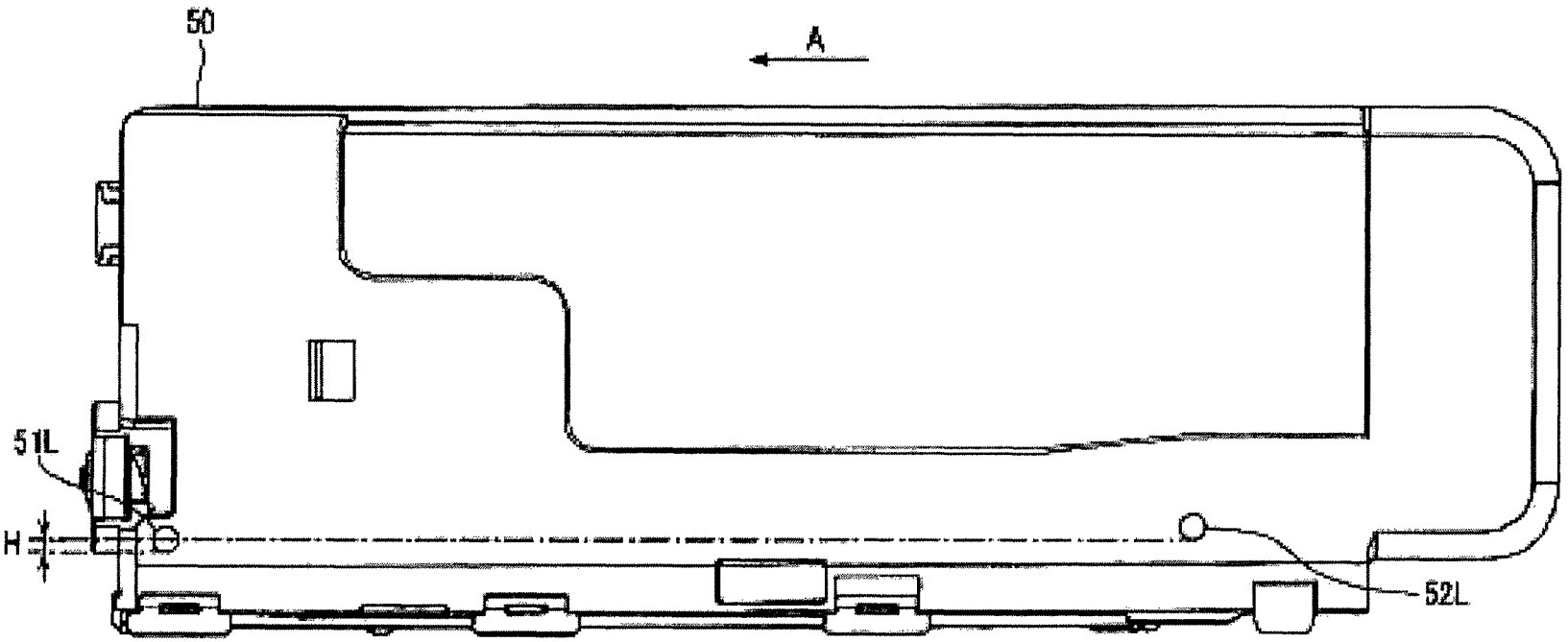
FIG. 10 is a side view of the toner cartridge according to one example embodiment.

FIG. 10 is a side view of the toner cartridge 50 according to one example embodiment and describes the posts 51L and 52L of the toner cartridge 50.

Referring to FIG. 10, a difference in height between the lower end of the post 51L of the toner cartridge 50 and the lower end of the post 52L may be H. In the present example embodiment, this difference H may be about 2 mm which is substantially the same as the difference Db in height between the lower surface of the first linear part 421R of the stage 40 and the lower surface of the second linear part 425R illustrated in FIG. 8.

One reason for this is to cause the bottom surface of the toner cartridge 50 to be in contact with the bottom plate 41B of the stage 40 in the toner cartridge attachment direction A when the toner cartridge 50 is attached to the stage 40 illustrated in FIG. 8. Accordingly, the openings 55*a*, 55*b*, and 55*c* of the toner cartridge 50 may be in contact with the openings 45*a*, 45*b*, and 45*c* of the stage 40, respectively.

Figure 11:
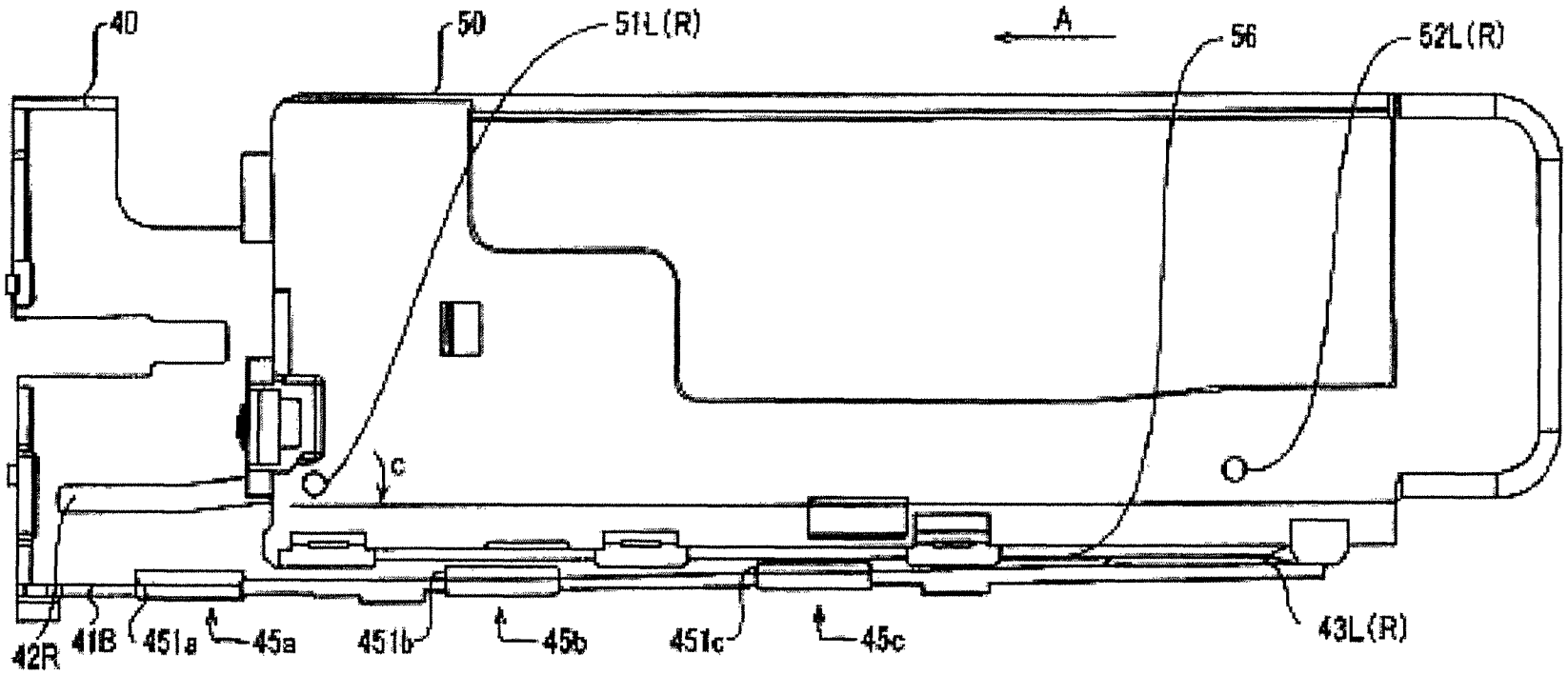
FIG. 11 describes a limiter of the stage according to one example embodiment.

FIG. 11 describes the limiter 43L (or 43R) of the stage 40 according to one example embodiment. FIG. 11 describes a state in which the toner cartridge 50 is in the middle of attachment to the stage 40. Specifically, FIG. 11 describes a state in which the posts 51L and 51R of the toner cartridge 50 illustrated in FIGS. 3 and 4 are fit into the rails 42L and 42R of the stage 40 illustrated in FIG. 7, respectively.

Referring to FIG. 11, the toner cartridge 50 may rotate around the post 51R in a direction indicated by an arrow "c" in FIG. 11 when the toner cartridge 50 is not fully attached to the stage 40.

Upon the rotation of the toner cartridge 50, the bottom surface of the toner cartridge 50 may be brought into contact with the limiters 43L and 43R. This may regulate the rotation of the toner cartridge 50. As a result, a gap may be provided between each of the sealing members 451*a*, 451*b*, and 451*c* of the stage 40 and the shutter 56 of the toner cartridge 50.

Figure 12:
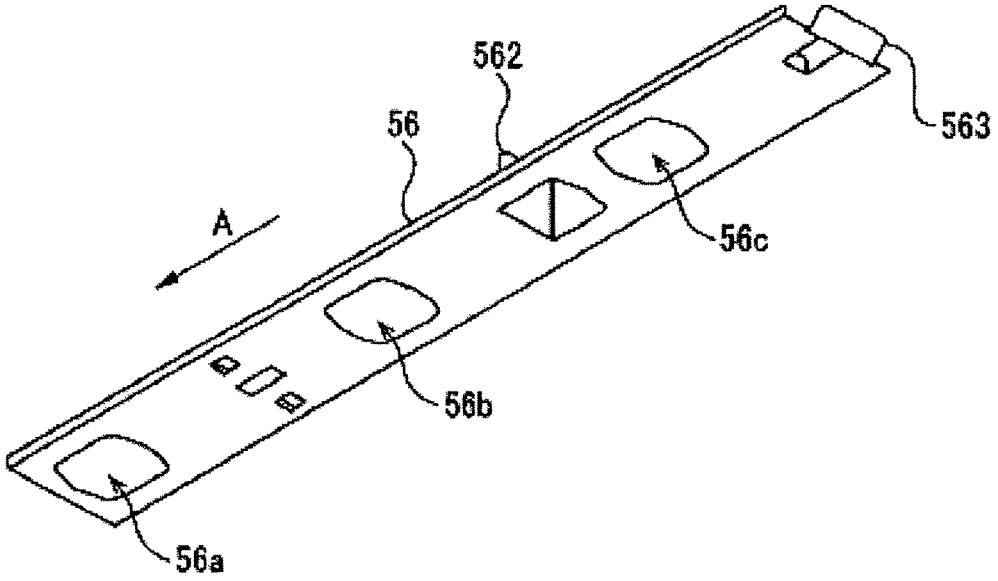
FIG. 12 is a perspective view of a shutter of the toner cartridge according to one example embodiment.

FIG. 12 is a perspective view of the shutter 56 of the toner cartridge 50 according to one example embodiment.

Referring to FIG. 12, the shutter 56 may have the openings 56*a*, 56*b*, and 56*c* in order from the downstream side in the toner cartridge attachment direction A. The openings 56*a*, 56*b*, and 56*c* may be so provided at substantially equal intervals as to correspond to the openings 55*a*, 55*b*, and 55*c* of the toner cartridge 50 illustrated in FIG. 6, respectively. As a result, sliding of the shutter 56 with respect to the toner cartridge 50 may allow the openings 55*a*, 55*b*, and 55*c* of the toner cartridge 50 to be opened or closed together.

Further, the engaged part 563 that is to be brought into engagement with the projection 46 of the stage 40 may be provided at the rear end of the shutter 56 in the toner cartridge attachment direction A. The engaged part 563 may protrude downward from the bottom surface of the shutter 56.

Figure 13A:
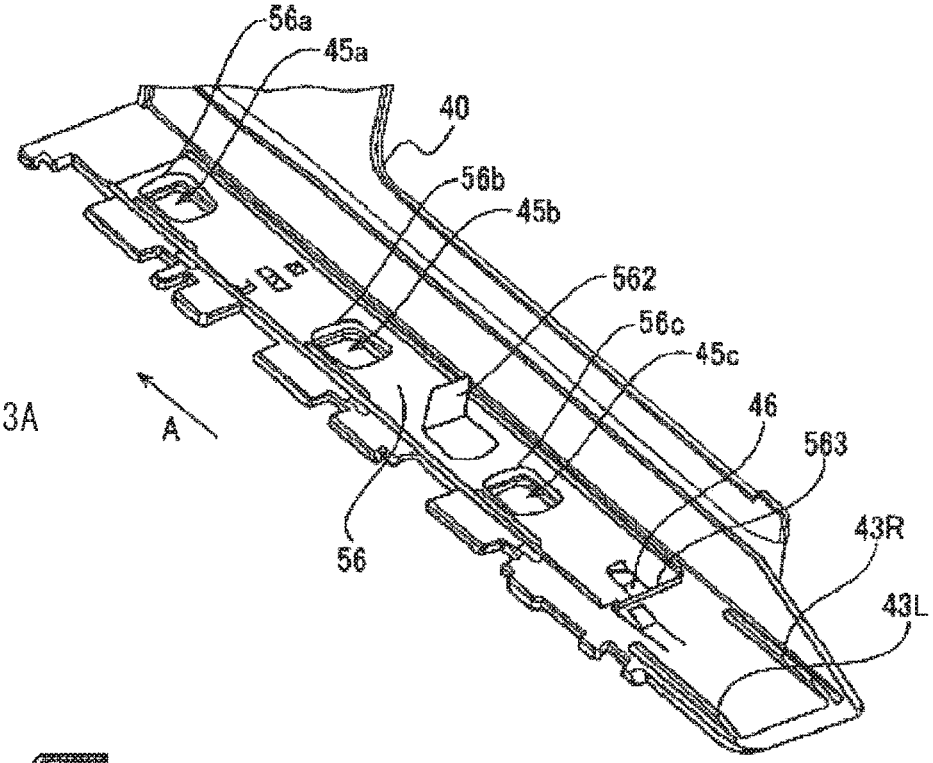
FIGS. 13A to 13C describe engagement of the shutter and the stage with each other according to one example embodiment.
Figure 13B:
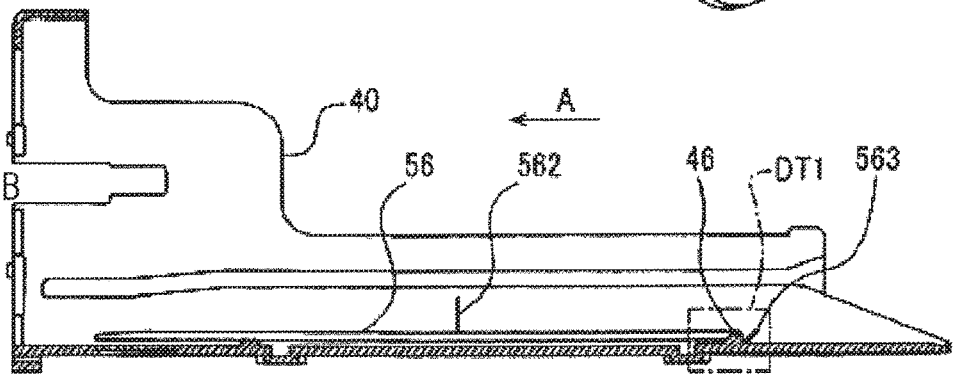
Figure 13C:
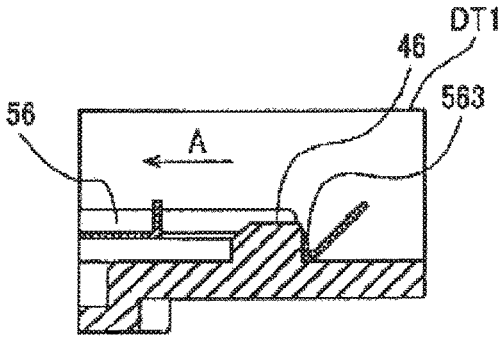

FIGS. 13A to 13C describe the engagement between the shutter 56 and the stage 40 according to the present example embodiment. Specifically, FIGS. 13A to 13C describe a state in which the engaged part 563 of the shutter 56 is brought into engagement with the projection 46 of the stage 40. FIG. 13A is a perspective view of the stage 40 and the shutter 56. FIG. 13B is a cross-sectional view of the stage 40 and the shutter 56. FIG. 13C enlarges an engagement part DT1 illustrated in FIG. 13B.

Referring to FIGS. 13A to 13C, the engaged part 563 of the shutter 56 may be brought into engagement with the projection 46 of the stage 40, thereby regulating the movement of the shutter 56 in the toner cartridge attachment direction A.

Accordingly, the shutter 56 may be so located that the openings 56*a*, 56*b*, and 56*c* of the shutter 56 correspond to the openings 45*a*, 45*b*, and 45*c* of the stage 40.

Workings according to the foregoing configuration are described below.

First, an operation of the image forming apparatus 1 is briefly described referring to FIG. 2.

The medium may be set in the medium container 3 in a state in which a tip end of the medium is drawn out by a user to the front of the medium container 3. The medium may be a roll of paper, for example. Thereafter, when the cover 6 is closed, the medium may be sandwiched between the container-side conveying roller 9 and the cover-side conveying roller 11.

The image forming apparatus 1 may cause the container-side conveying roller 9 to rotate while the medium is sandwiched between the container-side conveying roller 9 and the cover-side conveying roller 11. The image forming apparatus 1 may also cause one of each of the pairs of conveying rollers 22, 23, 24, 25, and 33 to rotate. The image forming apparatus 1 may thus convey the medium to the transfer belt 29 along the conveying path 21.

The medium conveyed to the transfer belt 29 may be conveyed by the transfer belt 29 and sequentially pass between the photosensitive drums 30*a*, 30*b*, and 30*c* of the image forming sections 27*a*, 27*b*, and 27*c* and the transfer rollers 31*a*, 31*b*, and 31*c*, respectively. At this time, the toner images formed on the respective surfaces of the photosensitive drums 30*a*, 30*b*, and 30*c* may be transferred onto a print surface of the medium.

The medium onto which the toner images have been transferred may be conveyed to the fixing unit 32. The toner images transferred onto the medium may be fixed by the fixing unit 32. Thereafter, the medium may be discharged by the pair of conveying rollers 33 from the medium discharge section 20.

The medium may be cut by the housing-side cutter 26 at a predetermined length. Therefore, the medium on which printing has been already performed and which has been cut at the predetermined length may be discharged from the medium discharge section 20.

An operation of attaching the toner cartridge 50 to the stage 40 is described below with reference to FIGS. 14A to 17C. FIGS. 14A, 15A, 16A, and 17A are each a left side view of the stage 40 and the toner cartridge 50. FIGS. 14B, 15B, 16B, and 17B are cross-sectional views of the stage 40 and the toner cartridge 50 corresponding to the left side views of FIGS. 14A, 15A, 16A, and 17A, respectively. FIGS. 15C, 16C, and 17C each enlarge a key part illustrated in FIGS. 15B, 16B, and 17B, respectively.

Figure 14A:
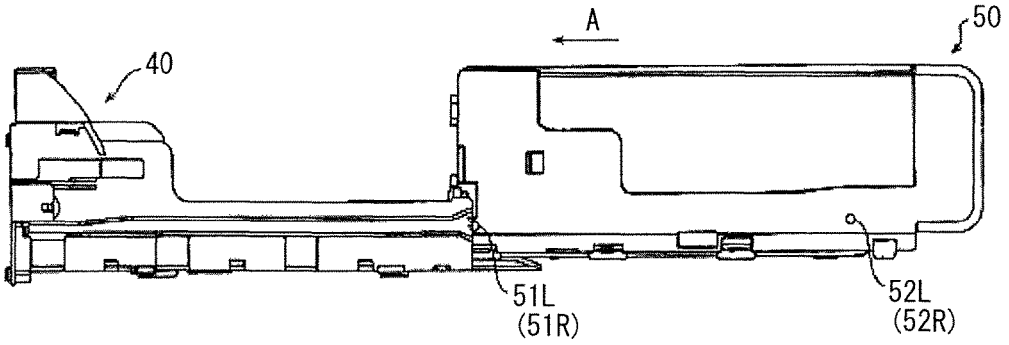
FIGS. 14A and 14B describe a position at which the engagement of the toner cartridge and the stage with each other is to be started.
Figure 14B:
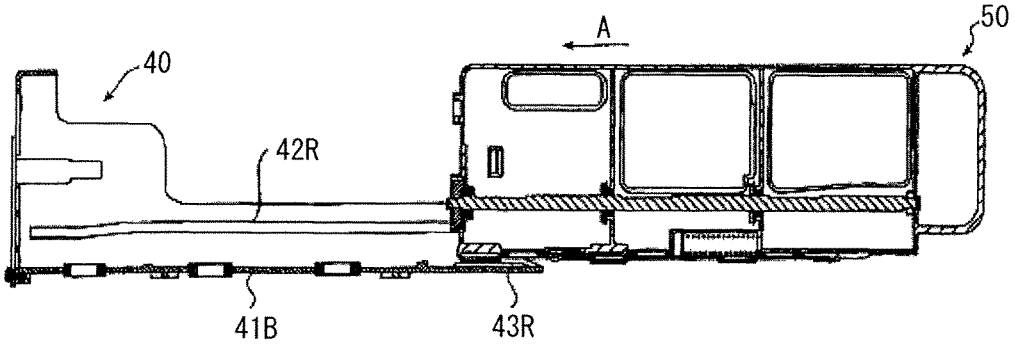

FIGS. 14A and 14B illustrate a state before the engagement of the post 51R of the toner cartridge 50 and the rail 42R of the stage 40 with each other.

In this state, the tip end of the bottom surface of the toner cartridge 50 in the toner cartridge attachment direction A may be brought into contact with the limiter 43R. This may cause the bottom surface of the toner cartridge 50 and the bottom plate 41B of the stage 40 to be separated away from each other with a predetermined gap in between.

Thereafter, the post 51R of the toner cartridge 50 may be fit into the rail 42R of the stage 40, and the toner cartridge 50 may be slid in the toner cartridge attachment direction A.

Figure 15A:
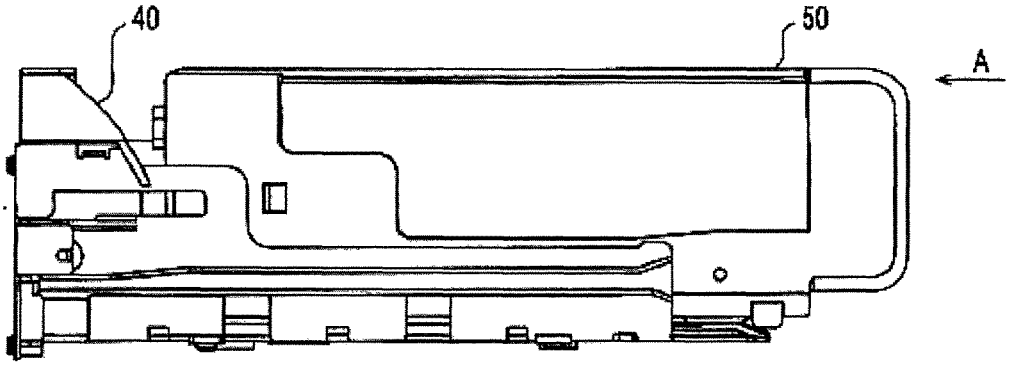
FIGS. 15A to 15C describe openings and outlets of the toner cartridge according to one example embodiment.
Figure 15B:
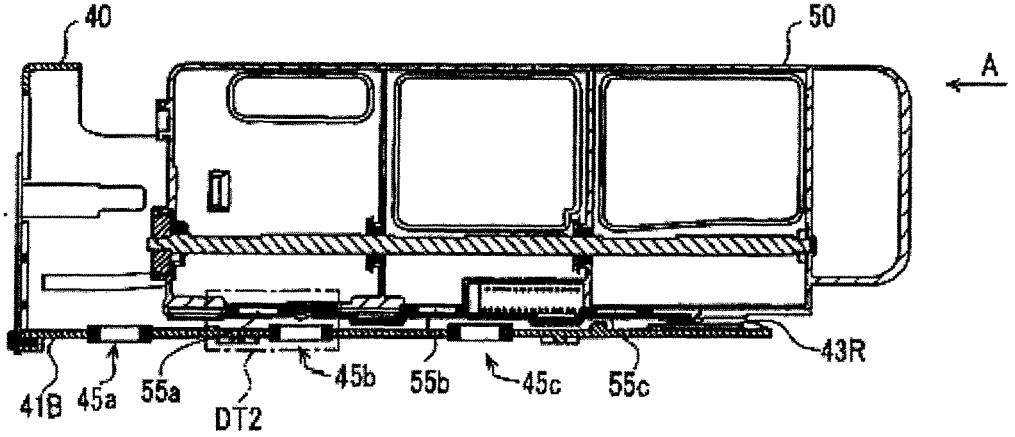
Figure 15C:
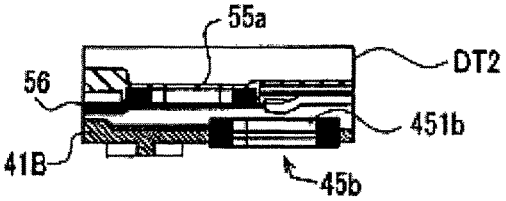

FIGS. 15A to 15C illustrate a state that is immediately before the posts 51L and 51R of the toner cartridge 50 illustrated in FIGS. 3 and 4 arrive at the first curves 422R and 422L of the rails 42R and 42L of the stage 40 illustrated in FIG. 8, respectively. FIG. 15C enlarges an engagement part DT2 illustrated in FIG. 15B.

In this state, the bottom surface of the toner cartridge 50 and the bottom plate 41B of the stage 40 may be separated away from each other with a predetermined gap in between, as illustrated in FIGS. 15B and 15C.

One reason for this is that, as illustrated in FIG. 8, the first linear parts 421R and 421L of the rails 42R and 42L of the stage 40 may be higher than the second linear parts 425R and 425L by the distance Db.

An upstream part of the bottom surface of the toner cartridge 50 in the toner cartridge attachment direction A may be brought into contact with the limiters 43R and 43L. This may cause the bottom surface of the toner cartridge 50 and the bottom plate 41B of the stage 40 to be separated away from each other with a predetermined gap in between.

Accordingly, as illustrated in FIG. 15C, the shutter 56 of the toner cartridge 50 and the sealing member 451*b* of the stage 40 may have a predetermined gap in between in a top-bottom direction.

It is to be noted that the shutter 56 of the toner cartridge 50 and the sealing member 451*c* of the stage 40 illustrated in FIG. 11 may also have a predetermined gap in between in the top-bottom direction.

In the foregoing manner, the shutter 56 of the toner cartridge 50 and the sealing member 451*b* of the opening 45*b* of the stage 40 may be separated away from each other until the opening 55*a* of the toner cartridge 50 passes by the opening 45*b* of the stage 40. In other words, the bottom surface of the toner cartridge 50 may not be brought into contact with the openings 45*a*, 45*b*, and 45*c* of the stage 40.

As a result, it is possible to suppress staining of the bottom surface of the toner cartridge 50 and staining of the openings 45*a*, 45*b*, and 45*c* of the stage 40 with the toner having the color other than the corresponding color.

It is to be noted that, in the state illustrated in FIGS. 14A to 15C, the shutter 56 of the toner cartridge 50 may be so biased by the spring 57 as to cause the openings 55*a*, 55*b*, and 55*c* to be closed as illustrated in FIG. 5.

Further, the toner cartridge 50 may be slid in the toner cartridge attachment direction A.

Figure 16A:
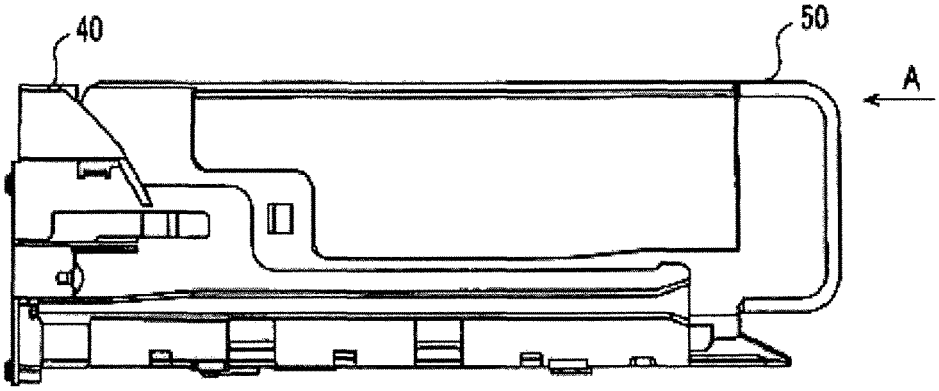
FIGS. 16A to 16C describe a position at which engagement related to the shutter is to be started according to one example embodiment.
Figure 16B:
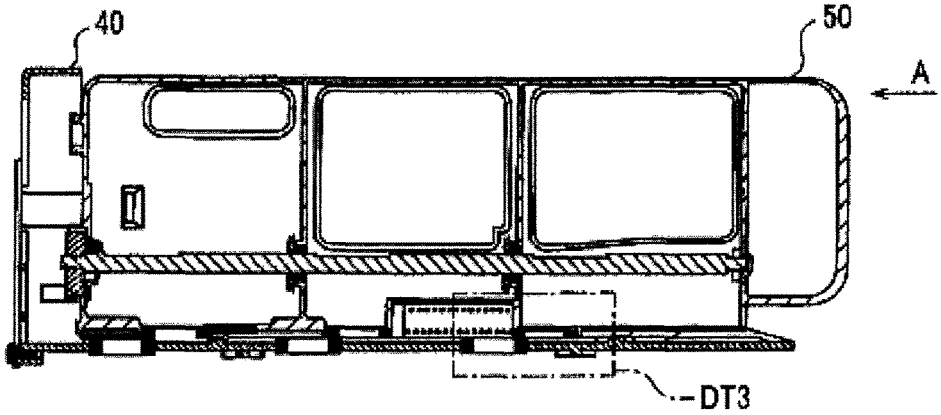
Figure 16C:
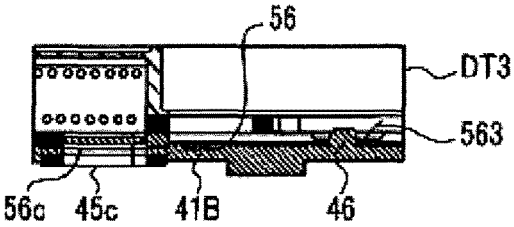

FIGS. 16A to 16C illustrate a state in which the posts 51L and 51R of the toner cartridge 50 illustrated in FIGS. 3 and 4 arrive at the second curves 424R and 424L of the rails 42R and 42L of the stage 40 illustrated in FIG. 8, i.e., the upstream ends of the second linear parts 425R and 425L in the toner cartridge attachment direction A, respectively. FIG. 16C enlarges an engagement part DT3 illustrated in FIG. 16B.

In this state, as illustrated in FIGS. 16B and 16C, the bottom surface (the first surface 502 illustrated in FIG. 9) of the toner cartridge 50 and the bottom plate 41B (the second surface 402 illustrated in FIG. 9) of the stage 40 may be brought into proximity to each other, and the projection 46 of the stage 40 may be brought into engagement with the engaged part 563 of the shutter 56 of the toner cartridge 50.

One reason for this is that, as illustrated in FIG. 8, the second linear parts 425L and 425R of the rails 42R and 42L of the stage 40 may be lower than the first linear parts 421R and 421L by the distance Db, respectively.

Accordingly, the movement of the shutter 56 in the toner cartridge attachment direction A may be regulated. As illustrated in FIG. 16C, upon the regulation of the movement of the shutter 56, the opening 56*c* of the shutter 56 and the opening 45*c* of the stage 40 may be located at positions that correspond to each other. Similarly, as illustrated in FIG. 6, the openings 56*a* and 56*b* of the shutter 56 and the openings 45*a* and 45*b* of the stage 40 may be located at positions that correspond to each other, respectively.

Further, as illustrated in FIG. 10, the difference H in height between the posts 51L and 51R and the posts 52L and 52R of the toner cartridge 50 may be substantially the same as the distance Db that is the difference in height between the second linear parts 425R and 425L and the first linear parts 421R and 421L of the rails 42R and 42L of the stage 40 illustrated in FIG. 8, respectively. This may allow the toner cartridge 50 to be substantially parallel to the stage 40, i.e., to maintain a substantially horizontal state upon movement of the toner cartridge 50 in the toner cartridge attachment direction A. It is therefore possible for the three openings 55*a*, 55*b*, and 55*c* of the toner cartridge 50 to be in contact with the three openings 45*a*, 45*b*, and 45*c* of the stage 40, respectively.

Further, the toner cartridge 50 may be slid in the toner cartridge attachment direction A.

Figure 17A:
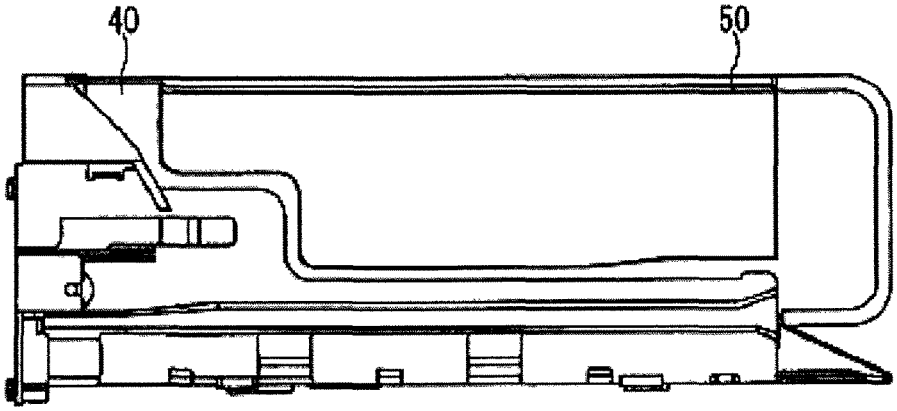
FIGS. 17A to 17C describe a position at which the toner cartridge is to be attached.
Figure 17B:
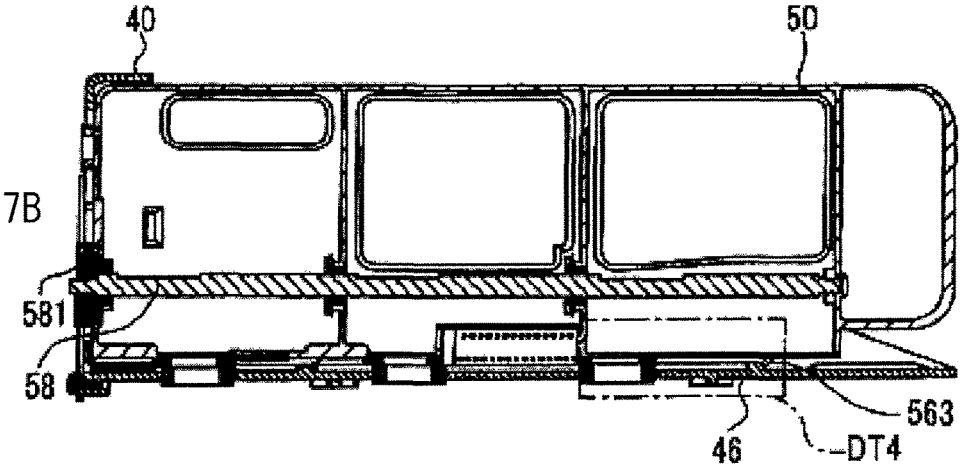
Figure 17C:
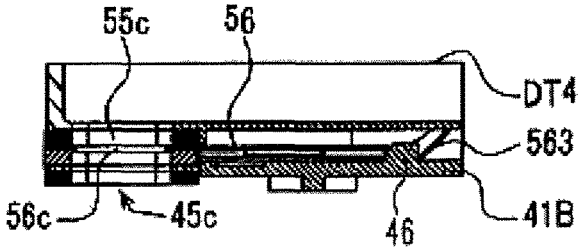

FIGS. 17A to 17C illustrate a state in which the posts 51L and 51R of the toner cartridge 50 illustrated in FIGS. 3 and 4 arrive at the terminal ends 426L and 426R of the rails 42L and 42R of the stage 40 illustrated in FIG. 8, respectively. FIG. 17C enlarges an engagement part DT4 illustrated in FIG. 17B.

In this state, as illustrated in FIGS. 17B and 17C, a state in which the bottom surface of the toner cartridge 50 and the bottom plate 41B of the stage 40 are brought into proximity to each other may be maintained. Further, the opening 55*c* of the toner cartridge 50, the opening 56*c* of the shutter 56, and the opening 45*c* of the stage 40 may be located at positions corresponding to each other. Similarly, the openings 56*a* and 56*b* of the shutter 56 illustrated in FIG. 6 and the openings 45*a* and 45*b* of the stage 40 illustrated in FIG. 7 may be located at positions corresponding to each other, respectively.

One reason for this is that, when the posts 51L and 51R of the toner cartridge 50 illustrated in FIGS. 3 and 4 arrive at the terminal ends 426L and 426R of the rails 42L and 42R of the stage 40 illustrated in FIG. 8, the movement of the toner cartridge 50 in the toner cartridge attachment direction A may be so regulated to be located that the openings 55*a*, 55*b*, and 55*c* of the toner cartridge 50 correspond to the openings 56*a*, 56*b*, and 56*c* of the shutter 56 the movement of which has already been regulated in the toner cartridge attachment direction A.

Accordingly, the toners contained in the toner cartridge 50 may pass through the openings (the openings 55*a*, 55*b*, and 55*c* illustrated in FIG. 6) of the toner cartridge 50, the openings (the openings 56*a*, 56*b*, and 56*c* illustrated in FIG. 6) of the shutter 56, and the openings (the openings 45*a* 45*b*, and 45*c* illustrated in FIG. 7) of the stage 40 and be dropped therefrom, thereby being fed to the respective image forming sections 27*a*, 27*b*, and 27*c*.

When the posts 51L and 51R of the toner cartridge 50 illustrated in FIGS. 3 and 4 arrive at the terminal ends 426L and 426R of the rails 42L and 42R of the stage 40 illustrated in FIG. 8, the gear 581 may come into mesh with a gear that is coupled to the drive source of the image forming apparatus 1 illustrated in FIG. 1, allowing for rotation of the stirring member 58.

As described above, in the present example embodiment, when the shutter 56 causes the openings 55*a*, 55*b*, and 55*c* to be opened by the engagement of the shutter 56 and the projection 46 in association with the operation of attaching the toner cartridge 50 to the stage 40, the first surface 502 of the toner cartridge 50 and the second surface 402 of the stage 40 may be separated away from each other until the openings 55*a*, 55*b*, and 55*c* of the toner cartridge 50 arrive at positions corresponding to the openings 45*a*, 45*b*, and 45*c*, respectively. Further, when the openings 55*a*, 55*b*, and 55*c* of the toner cartridge 50 arrive at the positions corresponding to the openings 45*a*, 45*b*, and 45*c* of the stage 40, respectively, the first surface 502 of the toner cartridge 50 and the second surface 402 of the stage 40 may be brought into proximity to each other. As a result, it is possible to feed the toners to the respective image forming sections 27*a*, 27*b*, and 27*c* by a single operation, i.e., the attachment of the toner cartridge 50 to the stage 40.

This makes it possible to improve usability of the toner cartridge 50 upon the feeding of the toners to the respective image forming sections 27*a*, 27*b*, and 27*c*.

The shutter 56 (the holding member 561) of the toner cartridge 50 may serve as the first surface 502, and the sealing members 451*a*, 451*b*, and 451*c* of the stage 40 may serve as the second surface 402 in the present example embodiment. However, the first surface and the second surface are not limited thereto. Alternatively, for example, a component configuring a lowermost surface of the toner cartridge 50 may serve as the first surface, and a component configuring an uppermost surface of the stage 40 may serve as the second surface.

Moreover, upon the attachment of the toner cartridge 50 to the stage 40, the openings 45*a*, 45*b*, and 45*c* of the stage 40 are not brought into contact with the bottom surface of the toner cartridge 50. This prevents mixture of colors of the toners.

The present example embodiment is described referring to an example of the image forming unit using three colors of toners. However, the number of colors of toilers is not limited to three. Alternatively, the image forming unit may use two or less colors of toilers or may use four or more colors of toilers. In such an alternative case, the toner containers, the openings, the shutter, etc. of the toner cartridge, and the openings, the guides, etc. of the stage may be determined depending on the number of types of the toilers.

An operation of detaching the toner cartridge 50, attached to the stage 40, from the stage 40 may be reverse in order of the operation of attaching the toner cartridge 50 to the stage 40. Specifically, the operation of detaching the toner cartridge 50 from the stage 40 may involve variation in state in order of FIGS. 17A to 17C, FIGS. 16A to 16C, FIGS. 15A to 15C, and FIGS. 14A and 14B.

As described above, according to the present example embodiment, it is possible to feed the toilers to the image forming unit by the single operation, i.e., the attachment of the toner cartridge to the stage. This achieves an effect that the usability of the toner cartridge which may correspond to a specific but non-limiting example of the "developer container" is improved upon the feeding of the toners which may correspond to a specific but non-limiting example of the "developer" to the image forming unit.

Further, the openings of the stage are not brought into contact with the bottom surface of the toner cartridge upon the attachment of the toner cartridge to the stage. This achieves an effect that the mixture of the colors of the toners is prevented.

The present example embodiment is described referring to an example in which the image forming apparatus is the printer using a medium such as a roll of paper. However, the image forming apparatus is not limited thereto. Alternatively, the image forming apparatus may be a printer that performs printing on pre-cut paper, for example. Alternatively, the image forming apparatus may be a facsimile apparatus, a multi-function peripheral (MFP), or any other apparatus as long as the image forming apparatus includes a plurality of image forming sections.

Although the technology has been described in terms of exemplary embodiments, it is not limited thereto. It should be appreciated that variations may be made in the described embodiments by persons skilled in the art without departing from the scope of the technology as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc.

are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming unit comprising:

a plurality of image forming sections;

a developer container containing a developer and having a plurality of developer containing sections, first openings, and an opening-closing member; and an attachment unit to which the developer container is to be attached detachably, and that has a plurality of second openings, a guide, and an engaging section, the developer containing sections being disposed side by side in an attachment direction in which the developer container is to be attached to the attachment unit, the first openings being provided in the respective developer containing sections, the opening-closing member being slidable in the attachment direction and causing each of the first openings to be opened and closed, the second openings being in communication with the respective image forming sections, the guide guiding the developer container in the attachment direction, and causing a first surface and a second surface to be brought into proximity to each other and to be separated away from each other, the first surface being provided with the opening-closing member of the developer container, the second surface being provided with the second openings, the engaging section being to be brought into engagement with the opening-closing member, wherein, when the opening-closing member causes the respective first openings to be opened by the engagement of the opening-closing member and the engaging section in association with an operation of attaching the developer container to the attachment unit, the first surface and the second surface are separated away from each other until arrival of the first openings at positions corresponding to the respective second openings, and the first surface and the second surface are brought into the proximity to each other upon the arrival of the first openings at the positions corresponding to the respective second openings.

2. The image forming unit according to claim 1, wherein the guide includes grooves into which respective protrusions are to be fit, and includes a first linear part, a second linear part, and a coupling part, the protrusions being provided on both sides of the developer container in the attachment direction, the first linear part being provided upstream of the second linear part in the attachment direction, the second linear part being provided downstream of the first linear part in the attachment direction, the coupling part coupling a downstream end of the first linear part in the attachment direction and an upstream end of the second linear part in the attachment direction to each other, the first linear part and the second linear part are substantially parallel to the second surface, and a distance from the first linear part to the second surface is greater than a distance from the second linear part to the second surface.

3. The image forming unit according to claim 2, wherein the protrusions are provided downstream of the first opening that is located most downstream out of the first openings in the attachment direction, and Ds>Dt is satisfied where Dt is a distance from each of the protrusions to an upstream end of the first opening that is located most downstream out of the first openings, and Ds is a distance from the downstream end of the first linear part to a downstream end of the second opening that is located second downstream out of the second openings in the attachment direction.

4. The image forming unit according to claim 3, wherein the first openings have respective lengths in the attachment direction that are substantially equal to each other, and Ls>Lt is satisfied where Ls is a length of the second linear part in the attachment direction, and Lt is the length of each of the first openings in the attachment direction.

5. The image forming unit according to claim 2, wherein the first surface and the second surface are brought into the proximity to each other when each of the protrusions of the developer container is located at the upstream end of the second linear part of the corresponding groove in the attachment direction.

6. The image forming unit according to claim 2, wherein the opening-closing member includes an engaged section, and the engaging section of the attachment unit is brought into engagement with the engaged section of the opening-closing member when each of the protrusions of the developer container is located at the upstream end of the second linear part of the corresponding groove in the attachment direction.

7. The image forming unit according to claim 1, wherein the developer container includes a biasing member that biases the opening-closing member in the attachment direction.

8. An image forming apparatus comprising the image forming unit according to claim 1.

9. A developer container comprising:

a plurality of developer containing sections that are disposed side by side in an attachment direction in which the developer container is to be attached to an attachment unit, and have respective first openings; and an opening-closing member that is slidable in the attachment direction and causes each of the first openings to be opened and closed, wherein, the developer container is detachably attachable to the attachment unit of an image forming unit, and, when the opening-closing member causes the respective first openings to be opened in association with an operation of attaching the developer container to the attachment unit, a first surface and a second surface are separated away from each other until arrival of the first openings at positions corresponding to respective second openings, and the first surface and the second surface are brought into proximity to each other upon the arrival of the first openings at the positions corresponding to the respective second openings, the first surface being provided with the opening-closing member, the second surface being provided with the second openings, the second openings being provided in the attachment unit.

* * * * *